US011859397B1

(12) United States Patent
Wells et al.

(10) Patent No.: US 11,859,397 B1
(45) Date of Patent: Jan. 2, 2024

(54) LOCKING MECHANISMS AND WEDGE SYSTEM FOR ADJUSTABLE TOE BOARD

(71) Applicant: Direct Scaffold Supply, LP, Houston, TX (US)

(72) Inventors: Matthew G. Wells, Houston, TX (US); Kevin Reinoso, Houston, TX (US)

(73) Assignee: Direct Scaffold Supply, LLC, Houston, TX (US)

( * ) Notice: Subject to any disclaimer, the term of this patent is extended or adjusted under 35 U.S.C. 154(b) by 0 days.

(21) Appl. No.: 15/955,680

(22) Filed: Apr. 17, 2018

Related U.S. Application Data

(60) Provisional application No. 62/486,409, filed on Apr. 17, 2017.

(51) Int. Cl.
*E04G 5/14* (2006.01)
*E04G 7/28* (2006.01)

(52) U.S. Cl.
CPC ..... *E04G 5/145* (2013.01); *E04G 5/142* (2013.01); *E04G 7/28* (2013.01); *E04G 2007/285* (2013.01)

(58) Field of Classification Search
CPC ... E04G 5/145; E04G 5/142; E04G 2007/285; E04G 7/28; E04G 2001/157
See application file for complete search history.

(56) References Cited

U.S. PATENT DOCUMENTS 1,836,126 A * 12/1931 Luce ..... A47B 57/26 108/42
2,289,844 A * 7/1942 Lamb ..... E04G 5/14 182/113
2,897,013 A * 7/1959 Delp ..... E04G 7/305 52/645
3,326,573 A * 6/1967 Neitzey, Jr. ..... B60D 1/155 280/482
3,471,189 A * 10/1969 Ness ..... E05B 65/0888 292/266
3,556,254 A * 1/1971 Lambert ..... E04G 5/08 182/223

(Continued)

FOREIGN PATENT DOCUMENTS

DE 3122593 A1 * 12/1982 ..... B63C 5/02
FR 3020080 B1 * 9/2016 ..... E04G 21/3228

(Continued)

*Primary Examiner* — Colleen M Chavchavadze
(74) *Attorney, Agent, or Firm* — Martinez Law Group PLLC; Melissa M. Martinez

(57) ABSTRACT

An exemplary embodiment of the invention includes a locking mechanism for use with the adjustable toe board to retain the toe board in its retracted position when necessary for transport, storage, or when the size of the portion of the platform the toe board will be used in requires the toe board to be in its fully collapsible state. The locking mechanism may be comprised of a latching member that is capable of automatic locking when the adjustable toe board is moved into its substantially retracted position. Further, the instant invention may be provided in any number of varying adjustable lengths to accommodate the various platform sizing through the use of a uniquely shaped wedge pin that is used with a fork to couple adjustable or non-adjustable toe boards to scaffolds and the like.

18 Claims, 18 Drawing Sheets

(56) References Cited

U.S. PATENT DOCUMENTS 3,848,854 A * 11/1974 De Barbieri ..... E04G 21/3219 256/70
4,348,128 A * 9/1982 Gostling ..... E04G 7/307 403/189
4,620,612 A * 11/1986 Enoki ..... E04G 3/30 182/113
4,840,513 A * 6/1989 Hackett ..... E04G 7/307 182/186.8
4,967,878 A * 11/1990 Adams ..... E04G 5/16 182/186.8
5,067,589 A * 11/1991 Bartnicki ..... E04G 1/152 182/119
5,842,685 A * 12/1998 Purvis ..... E04G 21/3223 182/113
6,027,276 A * 2/2000 Schworer ..... E04G 7/307 403/49
6,287,039 B1 * 9/2001 Leconte ..... B64G 1/641 244/158.1
6,405,830 B1 * 6/2002 Hayman ..... E04G 5/14 182/113
6,702,509 B2 * 3/2004 Rogers ..... E04G 7/14 403/385
6,872,039 B2 * 3/2005 Baus ..... F16B 21/125 411/347
7,222,696 B2 * 5/2007 Jackson ..... E06C 7/48 182/204
8,141,683 B1 * 3/2012 Wurth ..... E04G 1/367 182/223
9,835,188 B2 * 12/2017 Bacon ..... F16B 2/14
11,162,267 B1 * 11/2021 Santini ..... E04G 5/08
2013/0015015 A1 * 1/2013 Pedicone, Jr. ..... E04G 5/145 182/113
2018/0112420 A1 * 4/2018 Hayman ..... E04G 5/145

FOREIGN PATENT DOCUMENTS

GB 2536629 A * 9/2016 ..... E04G 5/142
JP 2011127339 A * 6/2011
KR 20210043260 A * 4/2021
WO WO-2012021065 A1 * 2/2012 ..... E04G 5/145
WO WO-2016071737 A1 * 5/2016 ..... E04G 7/28

* cited by examiner

LOCKING MECHANISMS AND WEDGE SYSTEM FOR ADJUSTABLE TOE BOARD

CROSS-REFERENCE TO RELATED APPLICATIONS

This application claims the benefit of U.S. provisional application Ser. No. 62/486,409 filed on Apr. 17, 2017, which is incorporated herein by reference as if reproduced in full below.

STATEMENT REGARDING FEDERALLY SPONSORED RESEARCH OR DEVELOPMENT

Not applicable.

FIELD OF THE DISCLOSURE

The disclosure relates generally to toe board systems for use with scaffolds and other items containing elevated platforms. More specifically, the disclosure is directed to adjustable toe boards having telescoping members and having locking mechanisms to maintain the toe boards in a substantially retracted position.

BRIEF SUMMARY OF THE DISCLOSURE

Scaffolds are commonly used to elevate workers and materials as needed for a variety of tasks, such as construction, repair, and maintenance of structures, bridges, refineries, and the like. There are many types of scaffolds, such as suspended scaffolding and supported scaffolds, such as tube and coupler, pole, mobile, frame and brace, cuplock and the like. Generally, scaffolds are comprised of a framework support having poles, legs, or uprights to allow for elevation of one or more platforms or scaffold decks. The scaffolds have generally tubular shaped, e.g., round or square in cross section, vertical members, such as scaffold posts or poles, located at points located along the perimeter of the platforms. The sizes of the vertical members varies with each scaffold structure and may vary depending on the manufacture of the scaffold system to be used. The invention allows for near universal coupling of a toe board, whether adjustable or not, with the variously sized vertical members through the new and unique shape of the wedge pin that is used in the disclosed wedge connector.

Toe boards are routinely utilized along the outermost edge of the various platforms situated in scaffolds to provide a barrier around the edge of the platform that will prevent the accidental rolling off or knocking off of tools, equipment, or other materials therefrom. The toe boards may also aid in preventing the workers from slipping at the platform's outermost edge.

The sizing of the platforms varies; therefore, differing lengths of toe boards may be utilized. Adjustable toe boards allow for application to a multitude of lengths of platforms to provide the desired coverage thereof. The instant invention may be provided in any number of varying adjustable lengths to accommodate the various platform sizing.

An exemplary embodiment of the invention includes a locking mechanism for use with the adjustable toe board to retain the toe board in its retracted position when necessary for transport, storage, or when the size of the portion of the platform the toe board will be used in requires the toe board to be in its fully collapsible state. The locking mechanism may be comprised of a self-contained latching member that is capable of automatic locking when the adjustable toe board is moved into its substantially retracted position.

The latching member may be removably attached to the toe board such that the latching member may be removed when replacement or repair of same is desired or necessary. This repair and/or replacement of the latching member may be accomplished on site either when the toe board is installed and in use or when the toe board is not in use. This ability for individual removal of the respective latching members allows for limited to no downtime when repairs or replacements of latching members are needed thereby allowing the job to proceed on schedule.

Various embodiments of an adjustable toe board are provided. The disclosed toe board is telescopic so that it may expand to accommodate a variety of platform lengths. Embodiments of the toe boards may be provided to be adjustable from about 60.96 cm (24") to 96.52 cm (38"); from about 96.52 cm (38") to 167.64 cm (66"), from about 167.64 cm (66") to 304.8 cm (120"), or in any other range as desired or needed to fit any platform. While the range of adjustability may vary, the toe board may be used in its substantially retracted position as well depending on the dimensions of the subject platform.

Other features and advantages of the various embodiments of the invention will be apparent from the following detailed description, the accompanying drawings, and the appended claims.

BRIEF DESCRIPTION OF THE DRAWINGS

For a more complete understanding of the embodiments of the invention, reference is now made to the following Detailed Description of Exemplary Embodiments of the invention, taken in conjunction with the accompanying drawings, in which.

DETAILED DESCRIPTION OF EXEMPLARY EMBODIMENTS

Figure 1A:
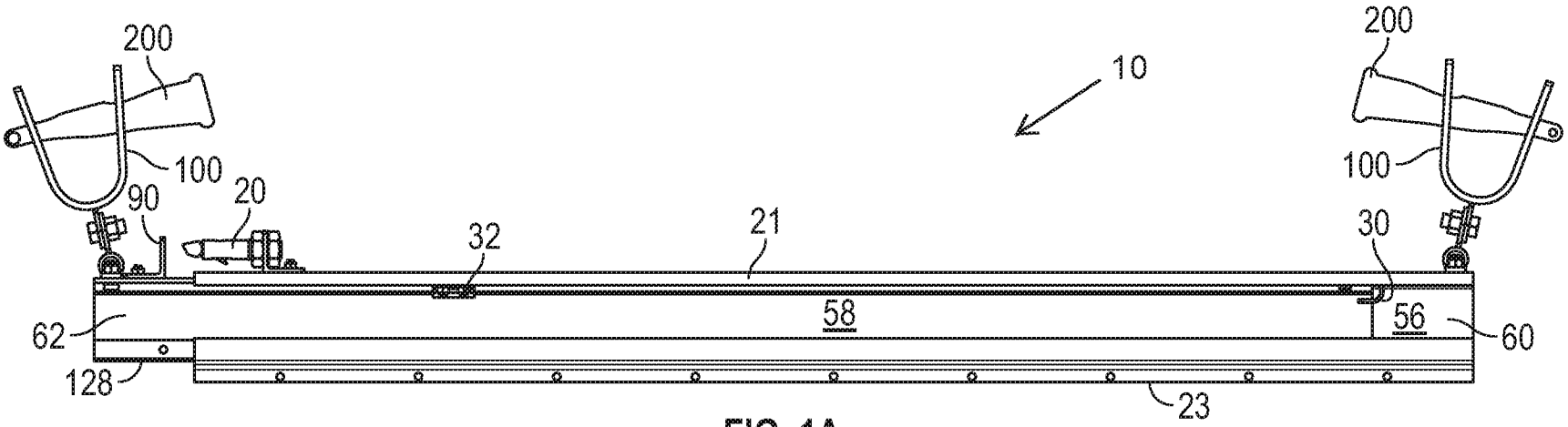
FIG. 1A is a top view of an adjustable toe board having a latching member and two connecting members coupled thereto when the adjustable toe board is in a slightly extended position and the latching member is not engaged.

The described exemplary and alternative embodiments of the invention are best understood by referring to the drawings, like numerals being used for like and corresponding parts of the various drawings.

Referring to FIGS. 1A, 1B, 2A, 2B, 3A, 3B, 3C, 3D, 4A, 4B, 4C, 4D and 5, an exemplary adjustable toe board 10 is shown with an exemplary embodiment of a locking mechanism 52. The adjustable toe board 10 is generally comprised of an inner toe board 62, an outer toe board 60, a plurality of connecting members 100 and a locking mechanism 52. The inner toe board 62 is at least partially retained along the outer toe board 60, wherein the inner toe board 62 and the outer toe board 60 are moveable in relation to each other. Each of the inner toe board 62 and the outer toe board 60 have at least one connecting member 100 affixed thereon, wherein the connecting members 100 connect to either of the other toe boards (adjustable or not) and/or a portion of the scaffold 98, such as at the scaffold post 102.

Referring to FIGS. 1A, 1B, 3A, 3B, 3C, 3D and 5, the outer toe board 60 is an elongated generally L-shaped member having an outer board upright portion 66 and an outer board base 64 extending therefrom. The outer board base 64 may be integrally formed from the same piece of material as the outer board upright portion 66 and may be permanently affixed to the outer board upright portion 66 though welding or some other means, or may be removable affixed to the outer board upright portion 66 through the use of fasteners, such as screws, tabs and slots, rackets, or rivets. The depicted outer toe board 60 has the outer board base 64 integrally formed from the same piece of material as the outer board upright portion 66.

The outer toe board 60 has an outer board upper edge 21 extending along its unattached upper edge and an outer board outer edge 23 extending along its unattached outer edge. More specifically, the outer board upper edge 21 extends longitudinally along the length of the unattached upper edge of the upright portion 66, distal the outer board base 64. The outer board outer edge 23 extends longitudinally along the length of the outer board base 64, distal the outer board upright portion 66. The outer board upright portion 66 and the outer board base 64 share a longitudinally extending outer board combined edge 22 along the length of the outer toe board 60 where the outer board upright portion 66 and the outer board base 64 meet.

The outer toe board 60 has an outer board first side 24 and an outer board second side 25. The outer board first side 24 extends the length of the perimeter of the side of the outer toe board 60 between the outer board upper edge 21 and outer board outer edge 23, with the outer board first side 24 being inclusive of the portion of the outer board upper edge 21 and outer board outer edge 23 adjacent thereto along the subject side of the outer toe board 60. The outer board second side 25 extends the length of the perimeter of the side of the outer toe board 60 between the outer board upper edge 21 and the outer board outer edge 23, the outer board second side 25 being distal the outer board first side 24, with the outer board second side 25 being inclusive of the portion of the outer board upper edge 21 and outer board outer edge 23 adjacent thereto along the subject side of the outer toe board 60.

Figure 3A:
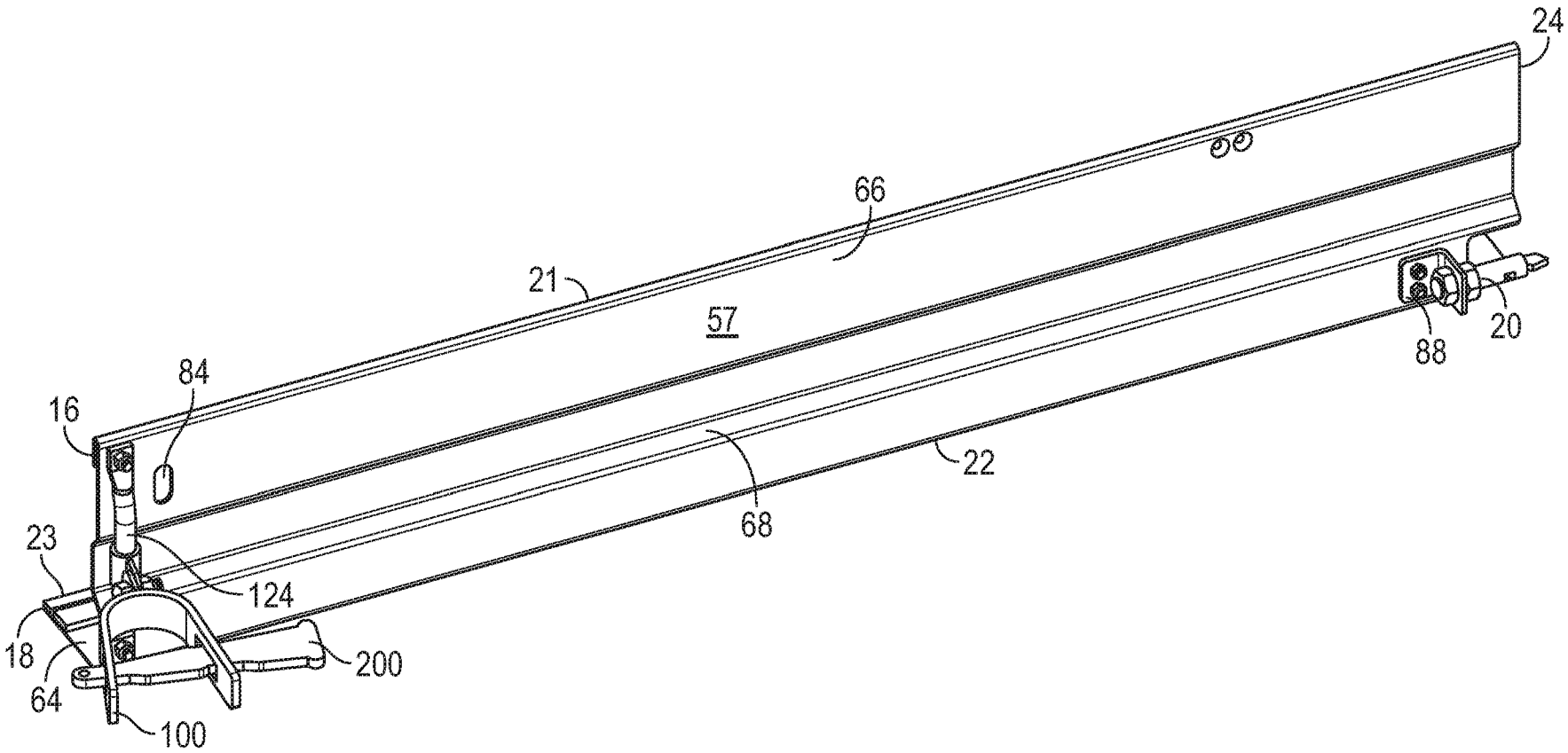
FIG. 3A is a perspective view of the back of the outer toe board.
Figure 3B:
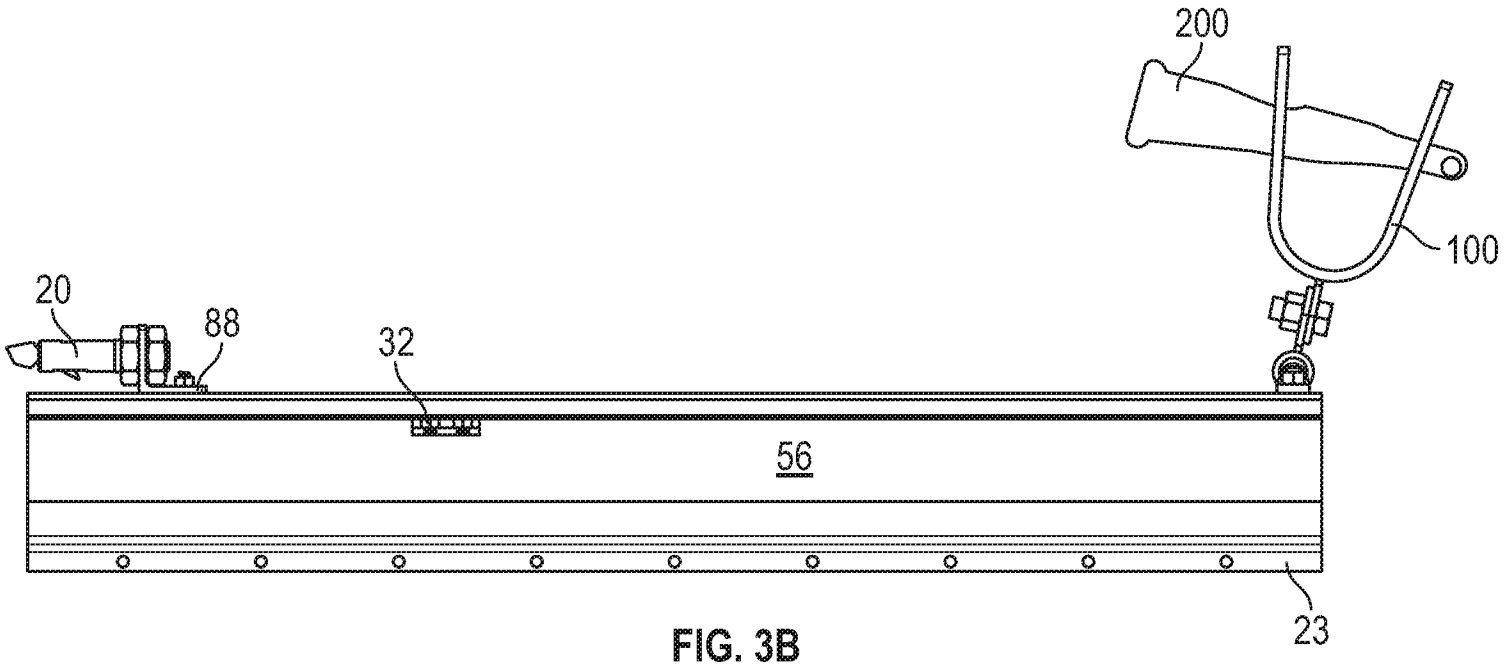
FIG. 3B is a top view of the outer toe board.
Figure 3C:
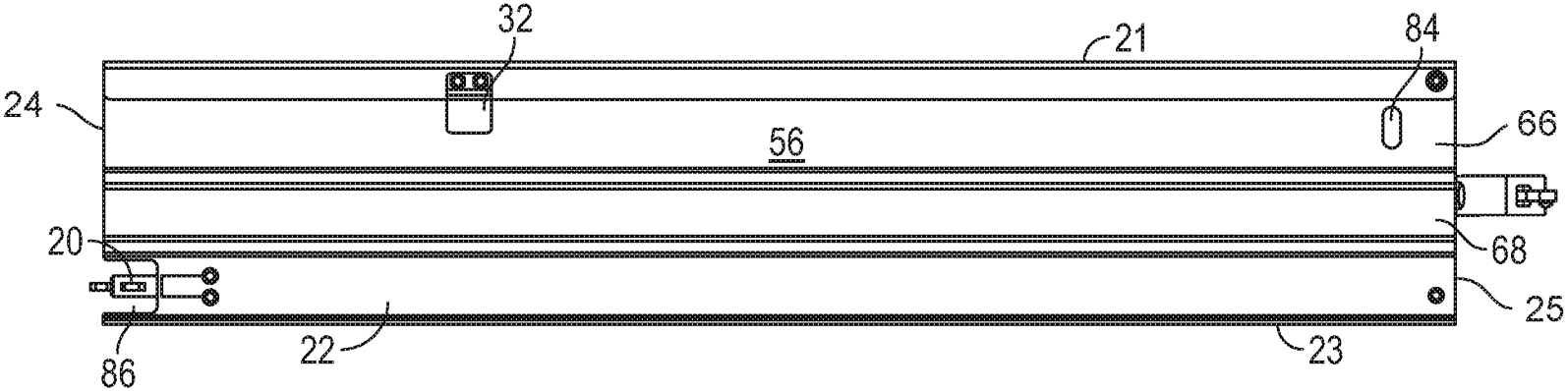
FIG. 3C is a front view of the outer toe board.
Figure 3D:
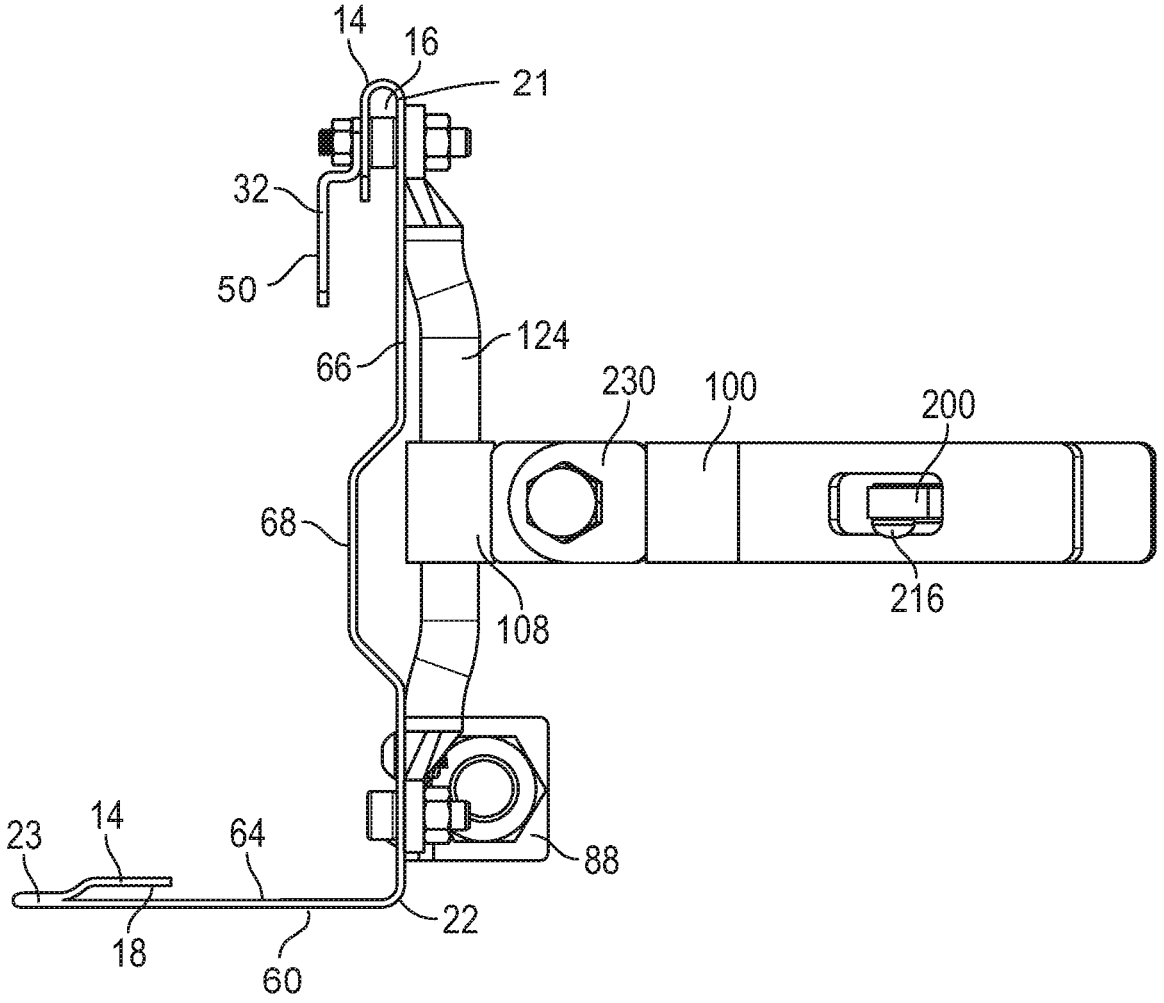
FIG. 3D is a side view of the outer toe board.
Figure 4A:
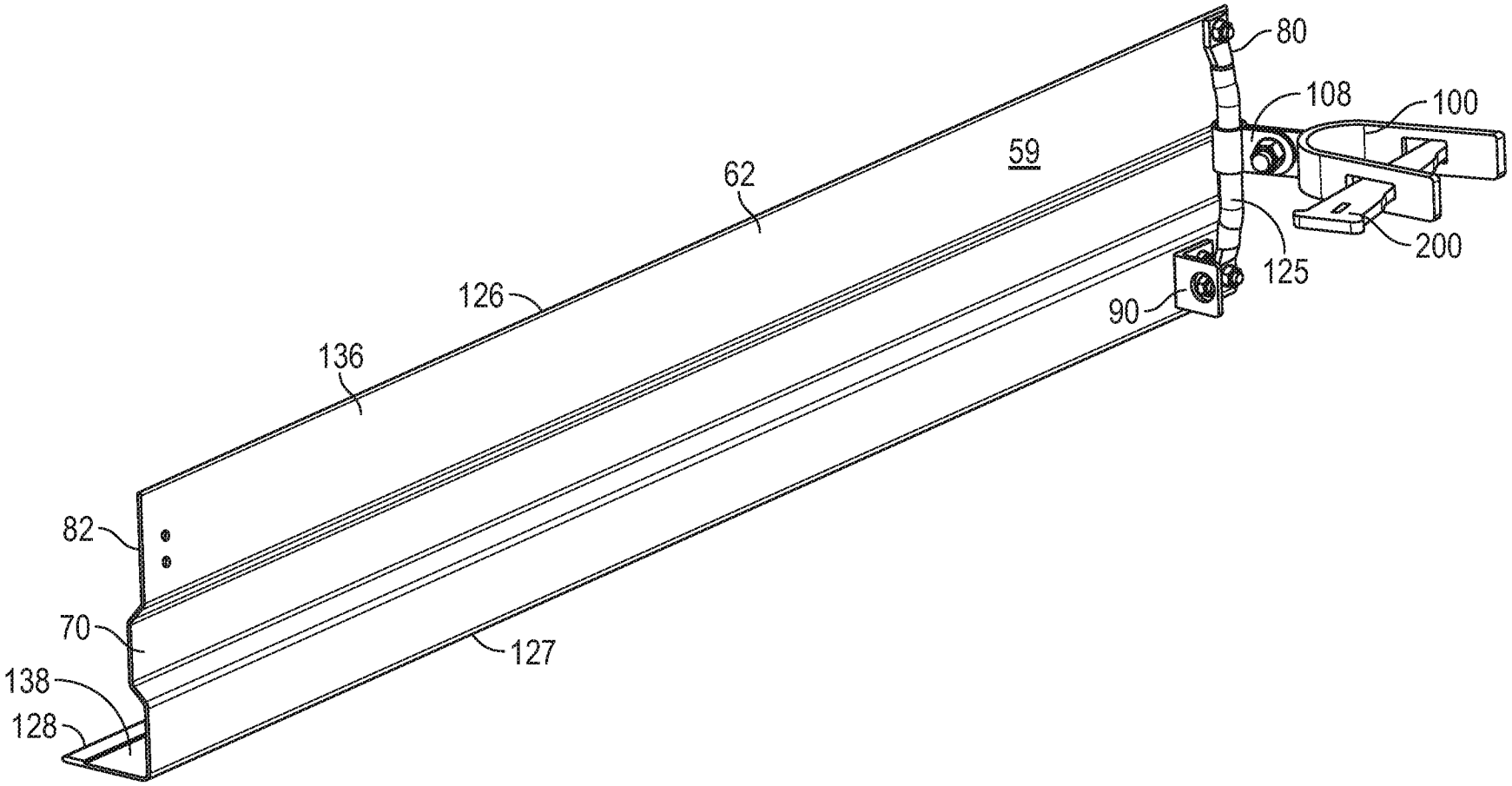
FIG. 4A is a perspective view of the back of the inner toe board.
Figure 4B:
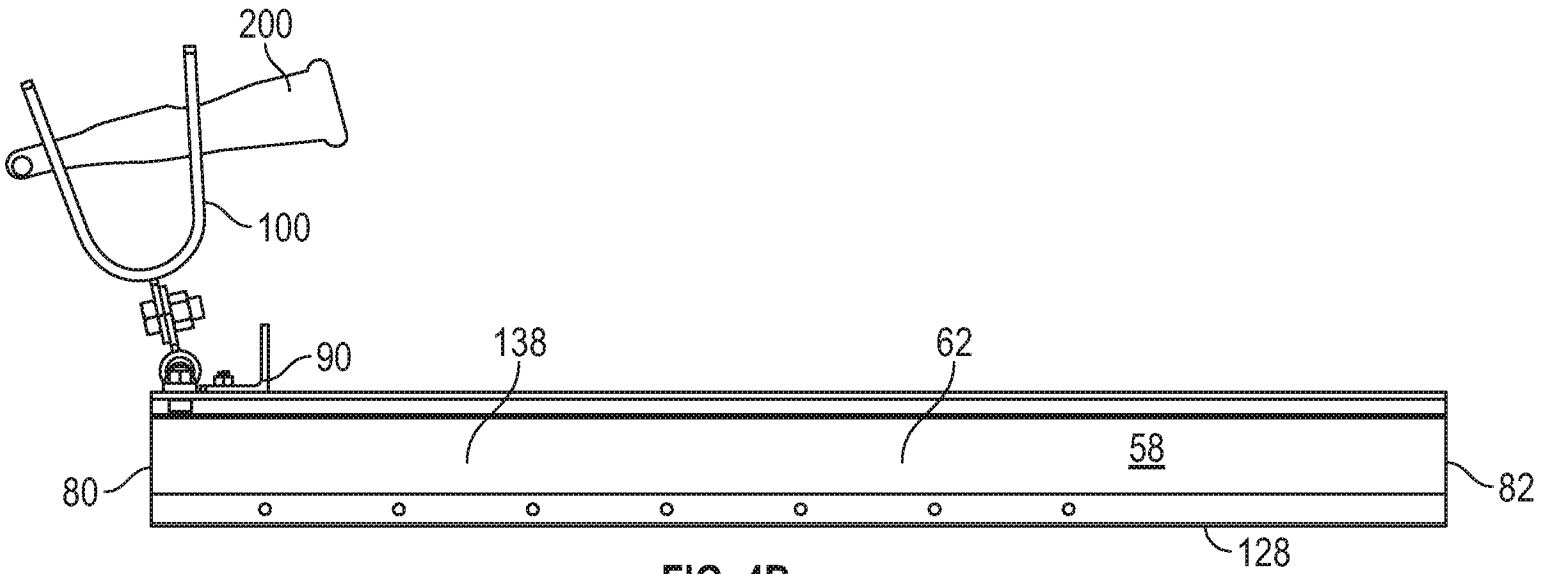
FIG. 4B is a top view of the inner toe board.
Figure 4C:
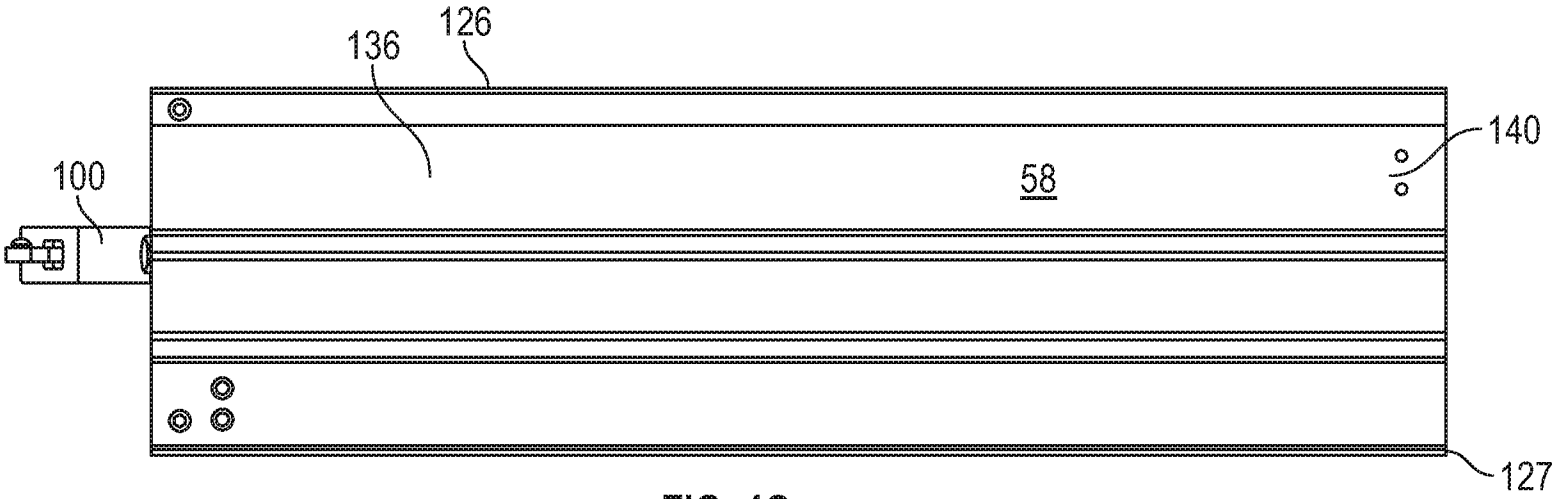
FIG. 4C is a front view of the inner toe board.
Figure 4D:
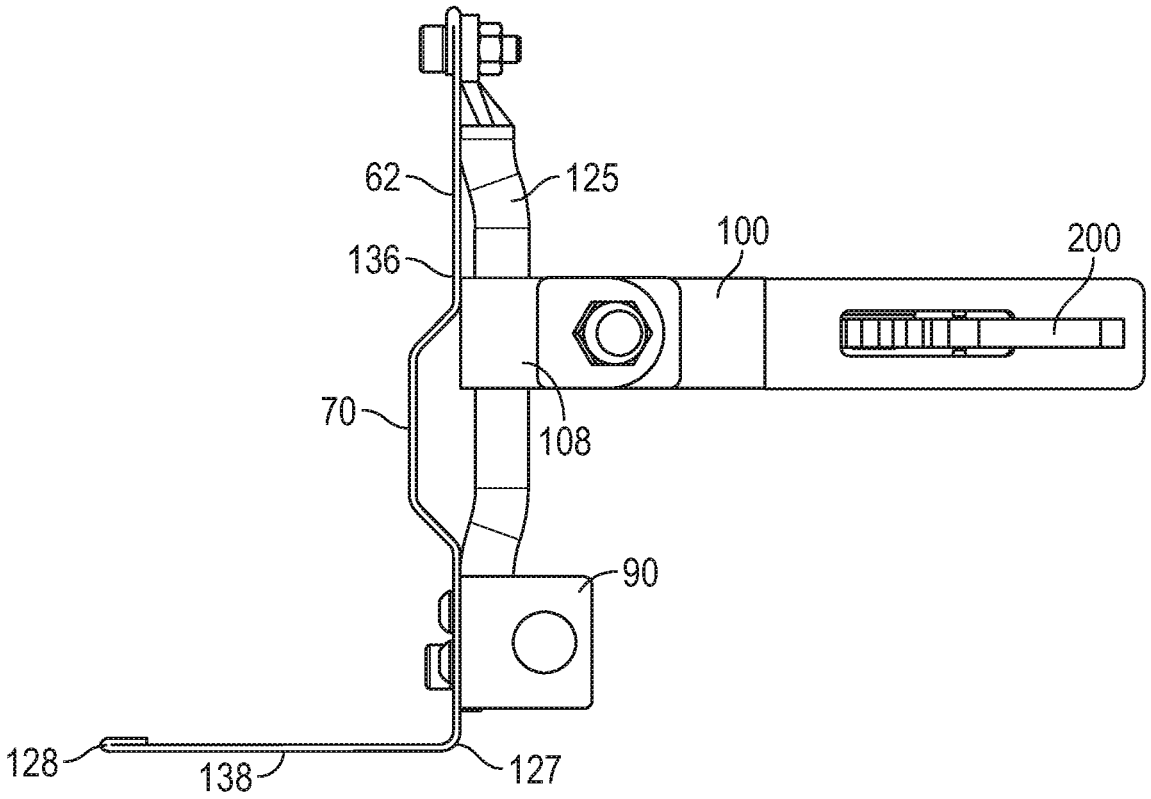
FIG. 4D is a side view of the inner toe board.

Referring to FIG. 3D, the outer toe board 60 comprises at least two retaining channels 14. An upright channel 16 is formed along at least a portion of the outer board upper edge 21 extending along at least a portion of the interior surface 56 of the outer toe board 60. The depicted exemplary embodiment shows the upright channel 16 extending the entire length of the outer board upper edge 21 and shows the upright channel 16 extending along the entire length of the interior surface 56 of the outer toe board 60 proximate the outer board upper edge 21. In alternative embodiments, the upright channel 16 may be discontinuous along its length and/or may end prior to reaching one or more to the outer toe board's 60 sides 24 and 25.

A base channel 18 is formed along at least a portion of the outer board outer edge 23 extending along at least a portion of the outer board interior surface 56. The depicted exemplary embodiment shows the base channel 18 extending the entire length of the outer board outer edge 23 and shows the base channel 18 extending along the entire length of the interior surface 56 of the outer toe board 60 proximate the outer board outer edge 23. In alternative embodiments, the base channel 18 may be discontinuous along its length and/or may end prior to reaching one or more to the outer toe board's 60 sides 24 and 25.

The upright channel 16 and/or base channel 18 may be formed integrally from the same piece of material as the outer toe board 60 as is shown in FIG. 3D. Alternatively, any or all of the retaining channels 14 may be permanently affixed to the outer toe board 60 though welding or some other means of fusing the retaining channel(s) 14 thereto. In a further alternative, the retaining channels 14 may be removably affixed to the outer toe board 60 through the use of fasteners, such as screws, tabs and slots, brackets, or rivets.

The retaining channels 14 are utilized to retain the inner toe board 62 in proximity to the outer toe board 60 such that the adjustable toe board 10 may be adjusted in length by movement of the inner toe board 62 in relation to the outer toe board 60 along the channels 14.

In the exemplary embodiment depicted in FIGS. 3A, 3B, 3C, and 3D, the outer board upright portion 66 contains a protrusion 68 intermediate the outer board upper edge 21 and the outer board combined edge 22. The protrusion 68 extends inward towards the outer board outer edge 23. The exemplary embodiment of the protrusion 68 extends along the entire length of the outer toe board 60. In alternative embodiments, the protrusion 68 may not extend the entire length of the outer toe board 60. In alternative embodiments, the protrusion 68 extends partially along the length of the outer toe board 60 proximate its second side 25 where the connecting member 100 is coupled to the outer toe board 60. The protrusion 68 provides some space for limited movement of the connecting member 100 along the connecting member anchor 124. Alternatively, the outer toe board 60 does not have a protrusion 68.

An access point 84 is formed as an orifice extending through a section of the outer board upright portion 66 proximate outer board second side 25. The access point 84 allows access for attachment of the limit hook 30 onto the inner toe board 62 when the inner toe board 62 is installed in the channels 14 and the adjustable toe board 10 is in a substantially retracted position. The fastening means, such as screws or bolts, that are used to attach the limit hook 30 to the inner toe board 62 may be installed through the access point 84 to fasten the limit hook 30 thereon.

Figure 5:
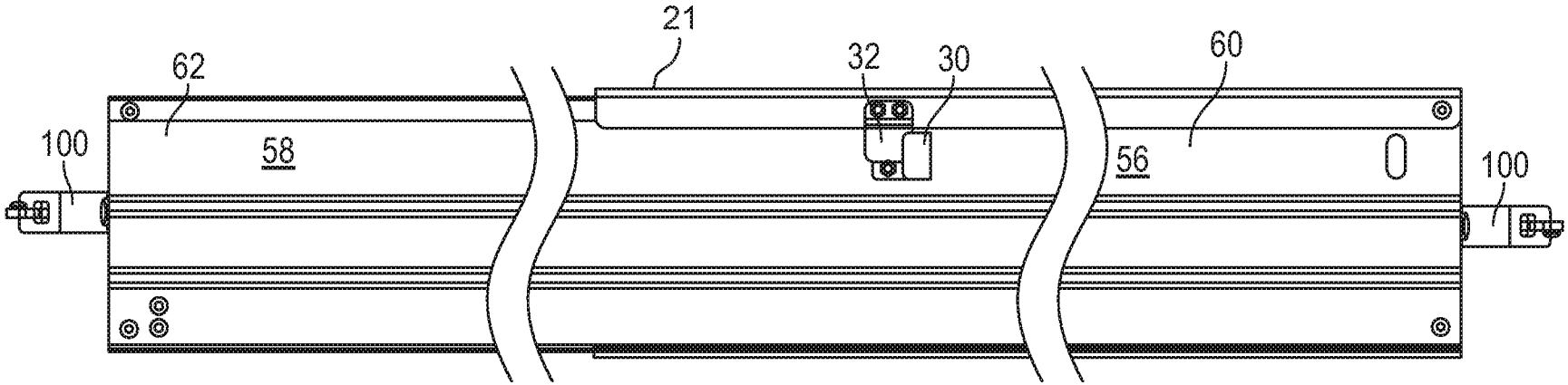
FIG. 5 is a front view of the adjustable toe board in its substantially expanded position.

The limit plate 32 is fastened proximate the outer board upper edge 21 and the upright channel 16 of the outer toe board 60. An engagement member 50 of the limit plate 32 extends away from the outer board upper edge 21 and towards the outer board combined edge 22. The engagement member 50 is positioned so that it will engage the limit hook 30, that is installed on the inner toe board 62, in order to prevent the uncoupling of the outer toe board 60 and the inner toe board 62. The engagement member 50 prevents the uncoupling by providing a fixed member that the limit hook 30 can hook onto when the limit plate 32 and limit hook 30 are in close proximity to each other, which occurs when the adjustable toe board 10 is in a substantially expanded position (as shown in FIG. 5). The action between the engagement member 50 of the limit plate 32 and the limit hook 30 prevents the inner toe board 62 from slipping out of the retaining channels 14 and disengaging from the outer toe board 60.

A latching member 20 is affixed to the exterior surface 57 of the outer toe board 60 proximate the outer board combined edge 22. The latching member 20 is positioned proximate the first side 24 of the outer toe board 60. A latching member anchor 88 is connected to the exterior surface 57 of the outer toe board 60 proximate the outer board combined edge 22. The exemplary latching member anchor 88 is L-shaped wherein its base portion is attached to the outer toe board 60 and its upper section is extending upward away from the outer toe board 60. The upper section of the latching member anchor 88 contains an aperture extending therethrough which allows for coupling of the latching member anchor 88 with the latching member 20 to retain the latching member 20 onto the outer toe board 60. At least a portion of the latching member 20 is installed in the latching member anchor 88 such that the latching member 20 is effectively affixed to the outer toe board 60 with the striking plate 40 of the latching member 20 facing towards the first side 24 of the outer toe board 60. Alternatively, any now known or later discovered means may be utilized to couple the latching member 20 to the outer toe board 60.

Figure 1B:
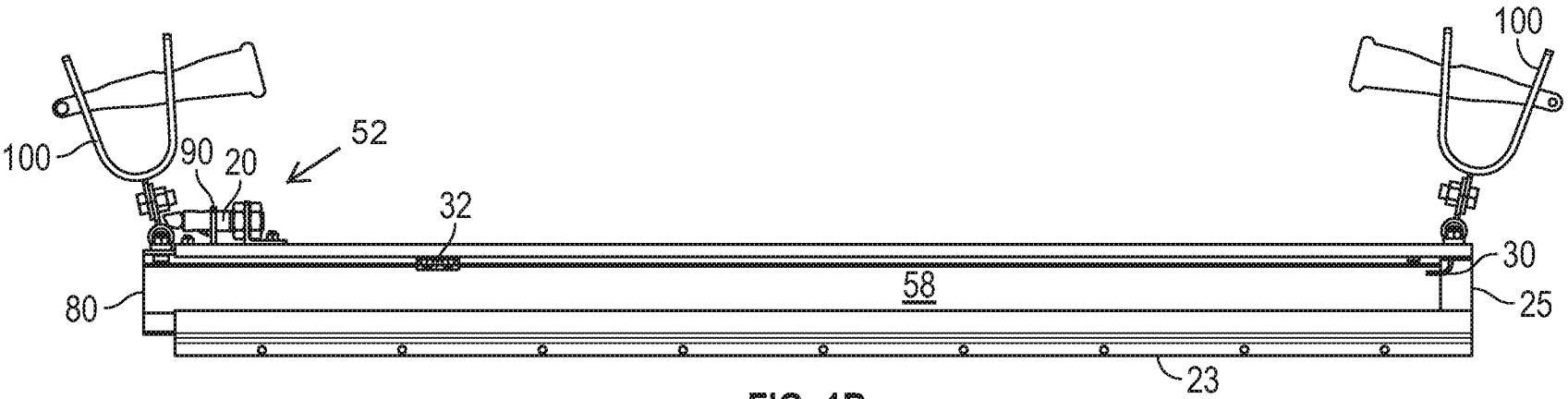
FIG. 1B is a top view of the adjustable toe board of FIG. 1A with the toe board in its substantially retracted position having the latching member engaged with the locking plate 90 thereby keeping the inner toe board from substantial movement in relation to the outer toe board.
Figure 2A:
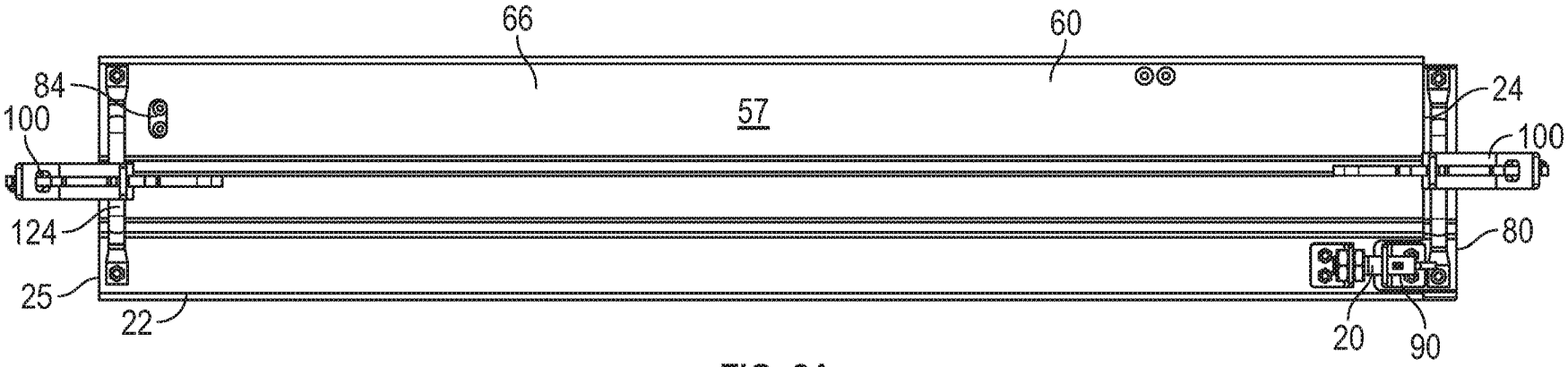
FIG. 2A is a back view of the adjustable toe board of FIG. 1A in the substantially retracted position.
Figure 2B:
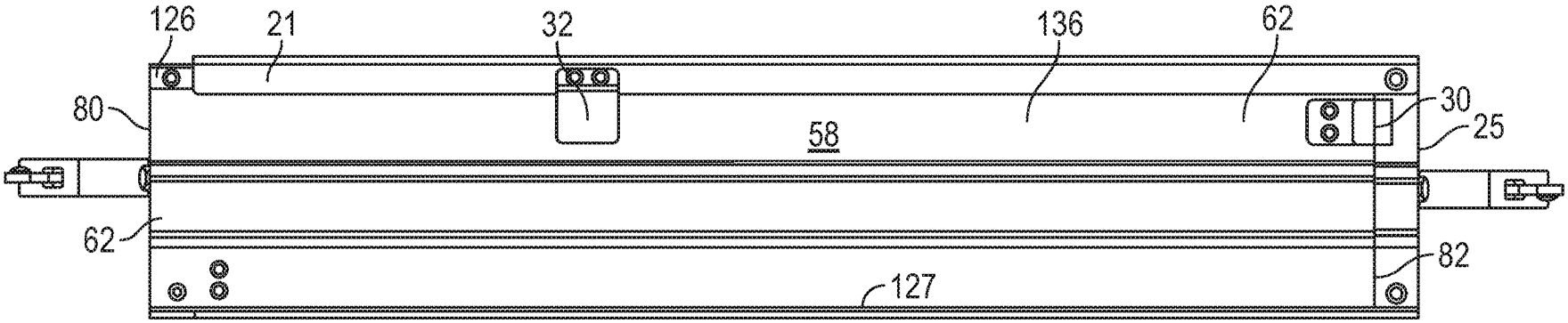
FIG. 2B is a front view of the adjustable toe board of FIG. 1A in the substantially retracted position.

A latching member aperture 86 is formed along a section of the outer board upright portion 66 proximate the outer board first side 24 and the outer board combined edge 22. The latching member aperture 86 extends from the first side 24 of the outer toe board 60 to a position intermediate the first side 24 of the outer toe board 60 and the installation site of the latching member anchor 88. The latching member aperture 86 is formed to allow the locking plate 90 that is installed on the inner toe board 62 to interact with the latching member 20, wherein during the interaction between the locking plate 90 and latching member 20 a portion of the locking plate 90 may enter the latching member aperture 86 (as seen in FIGS. 1B and 2A).

Referring to FIGS. 1A, 1B, 4A, 4B, 4C and 4D, the inner toe board 62 is an elongated generally L-shaped member having an inner board upright portion 136 and an inner board base 138 extending therefrom. The inner board base 138 may be integrally formed from the same piece of material as the inner board upright portion 136 and may be permanently affixed to the inner board upright portion 136 though welding or some other means, or may be removable affixed to the inner board upright portion 136 through the use of fasteners, such as screws, tabs and slots, brackets, or rivets. The depicted inner toe board 62 has the inner board base 138 integrally formed from the same piece of material as the inner board upright portion 136.

The inner toe board 62 has an inner board upper edge 126 extending along its unattached upper edge and an inner board outer edge 128 extending along its unattached outer edge. More specifically, the inner board upper edger 126 extends longitudinally along the length of the unattached upper edge of the inner board upright portion 136, distal the inner board base 138. The inner board outer edge 128 extends longitudinally along the length of the inner board base 138, distal the inner board upright portion 136. The inner board upright portion 136 and the inner board base 138 share a longitudinally extending inner board combined edge 127 along the length of the inner toe board 62 where the inner board upright portion 136 and the inner board base 138 meet.

The inner toe board 62 has an inner board first side 80 and an inner board second side 82. The inner board first side 80 extends the length of the perimeter of the side of the inner toe board 62 between the inner board upper edge 126 and the inner board outer edge 128, with the inner board first side 80 being inclusive of the portion of the inner board upper edge 126 and inner board outer edge 128 adjacent thereto along the subject side of the inner toe board 62. The inner board second side 82 extends the length of the perimeter of the side of the inner toe board 62 between the inner board upper edge 126 and the inner board outer edge 128, the inner board second side 82 being distal the inner board first side 80, with the inner board second side 82 being inclusive of the portion of the inner board upper edge 126 and inner board outer edge 128 adjacent thereto along the subject side of the inner toe board 62.

In the exemplary embodiment depicted, the inner board upright portion 136 contains a protrusion 70 intermediate the inner board upper edge 126 and the inner board combined edge 127. The inner board protrusion 70 is shaped to fit around the outer board protrusion 68 when the inner toe board 62 and outer toe board 60 are coupled. The protrusion 70 extends inward towards the inner board outer edge 128. The exemplary embodiment of the protrusion 70 extends along the entire length of the inner toe board 62. In alternative embodiments, the protrusion 70 may not extend the entire length of the inner toe board 62. In alternative embodiments, the protrusion 70 extends partially along the length of the inner toe board 62 proximate its first side 80 where the connecting member 100 is coupled to the inner toe board 62. The protrusion 70 provides some space for limited movement of the connecting member 100 along the connecting member anchor 125. Alternatively, the inner toe board 62 does not have a protrusion 70.

When coupled, the inner board upper edge 126 is slid into the upright channel 16 of the outer toe board 60 and the inner board outer edge 128 is slid into the base channel 18 so that the inner toe board 62 may be installed onto the outer toe board 60. The inner toe board 62 is movable in relation to the outer toe board 62 along the retaining channels 14 between a substantially retracted position (shown in FIGS. 2 and 2A) and a substantially extended position (shown in FIGS. 3 and 3A). The adjustable toe board 10 may be retained in its substantially retracted position, its substantially extended position, or any position therebetween when installed on a scaffold as needed.

The limit hook 30 is fastened proximate the inner board upper edge 126 and the inner board second side 82 at the limit hook installation location 140. When the inner toe board 62 is first installed on the adjustable toe board 10, once the inner board upper edge 126 and the inner board outer edge 128 are aligned with, and placed in, the retaining channels 14, and the inner toe board 62 is positioned in its substantially retracted position in relation to the outer toe board 60, then the limit hook 30 may then be fastened onto the inner toe board 62 through use of the access point 84 on the outer toe board 60.

The limit hook 30 is shown as installed at the limit hook installation location 140 in FIGS. 2A and 3A. The limit hook 30 has a hooking portion extending from the interior surface 58 of the inner toe board 62 for connecting with and hooking onto the engagement member 50 of the limit plate 32. The interaction between the engagement member 50 of the limit plate 32 and the limit hook 30, as seen in FIG. 5, prevents the uncoupling of the inner toe board 62 from the outer toe board 60 when the adjustable toe board 10 is in its substantially extended position.

A locking plate 90 is attached to the inner toe board 62 proximate the inner board combined edge 127 and the inner board first side 80. The locking plate 90 is L-shaped wherein its base is attached to the exterior surface 59 of the inner toe board 62, and its upper section is extending upward away from the inner toe board 62. The upper section of the locking plate 90 contains an aperture extending therethrough which allows for coupling of the latching member 20 with the locking plate 90 to retain the adjustable toe board 10 in its substantially retracted position. At least a portion of the locking plate 90 may extend within the latching member aperture 86 on the outer toe board 60 when the adjustable toe board 10 is in its substantially retracted position.

Referring to FIGS. 6, 6A, 6B, 6C, 7A and 7B, an exemplary embodiment of the self-contained latching member 20 is shown. The latching member 20 comprises a latching member body 28 that is generally cylindrical in shape having a retaining end 94 and an opposite anchoring end 96. The latching member body 28 has a cavity opening 36 at its retaining end 94 from which an internal cavity 35 extends at least partially within the interior of the latching member body 28, wherein the cavity 35 ends at its innermost interior wall 112. A threaded surface 34 extends along at least a portion of the outer surface of the latching member body 28 proximate its anchoring end 96.

An internal protrusion 46 protrudes into the cavity 35 of the latching member body 28 intermediate the cavity opening 36 and the innermost interior wall 112. The internal protrusion 46 may be formed by placing enough pressure on the outside surface of the latching member body 28 to create a depression 44 along a portion of its outer surface, which will bend the material thereby causing the internal protrusion 46. Alternatively, the internal protrusion 46 may be formed by any now known or later discovered means.

The latching member body 28 has an aperture 38 extending along at least a portion of its outer surface. The aperture 38 extends through a sidewall of the latching member body 28 thereby creating a passage from the exterior of the latching member body 28 into its cavity 35. The aperture 38 is positioned opposite the internal protrusion 46. The front edge 148 of the aperture 38 is disposed proximate the retaining end 94 of the latching member body 28. The front edge 148 of the aperture 38 and the cavity sidewall intermediate the front edge 148 and the cavity opening 36 define a cavity engagement surface 48 for engaging portions of the striking plate 78 and the retaining member 134.

While a generally cylindrical latching member body 28 is disclosed in the depicted exemplary embodiments, this shape is not a strict requirement. Alternative exemplary embodiments of the latching member body 28 may be cuboidal or prismed shaped, or of any other geometry that allows for the retainment of at least a portion of a retaining member 134 and/or a striking plate 78 along a side of the latching member body 28 for releasably retaining the adjustable toe board 10 in its substantially retracted position.

A resilient member 42 is retained within the cavity 35 of the latching member body 28. The resilient member 42 shown is a curved strip of resilient material having a space 152 extending between its opposing arms. The resilient member 42 is capable of being compressed such that the space 152 between its opposing arms is reduced yet it is also capable of returning to its original form once the compression of the resilient member 42 is released, i.e., the resilient member 42 is capable of being spring loaded. The resilient member 42 has respective opposing ends on its opposing arms: a stop end 120 and a retaining member engagement end 122. The base 118 of the resilient member 42, from which the opposing arms extend from, is disposed intermediate the stop end 120 and the retaining member engagement end 122.

The resilient member 42 is disposed within the cavity 35 of the latching member body 28, wherein the base 118 of the resilient member 42 abuts the innermost interior wall 112 of the cavity 35. The stop end 120 of the resilient member 42 abuts the internal protrusion 32 such that the positioning of the base 118 against the innermost interior wall 112 and the positioning of the stop end 120 against the internal protrusion 32 act to retain the resilient member 42 in position within the cavity 35, whether the resilient member 42 is under pressure and in a compressed state or not.

The width of the resilient member 42 is generally equal to the width of the cavity 35 proximate the internal protrusion 32. While the width of the resilient member 42 is preferably the same as or slightly smaller than the width of the corresponding section of the cavity 35, the width of the resilient member 42 may be uniform along the length of the resilient member 42 or may vary along the length of the resilient member 42. Alternatively, the width of the resilient member 42 may not be the same or may be slightly smaller than the width of the corresponding section of the cavity 35.

Alternative embodiments of the resilient member 42 include coiled springs, barrel type springs, and other now known or later discovered spring or spring-like materials. A purpose of the resilient member 42 is to cause the retaining member 134 to extend at least partially through the aperture 38 of the latching member body 28. A further purpose of the resilient member 42 is to compress in order to allow the retaining member 134 to be depressed by either a user, the locking plate 90, or otherwise (see FIG. 6C). A further purpose of the resilient member 42 is to return to its un-compressed state once the compressive pressure on the resilient member 42 is removed and to act on the retaining member 134 by moving the retaining member 134 into its uncompressed position (see FIG. 6B). Therefore, the resilient member 42 may be as depicted in the exemplary embodiment or may be any type of resilient member 42 with spring-like resiliency that can perform the stated functions.

Figure 6:
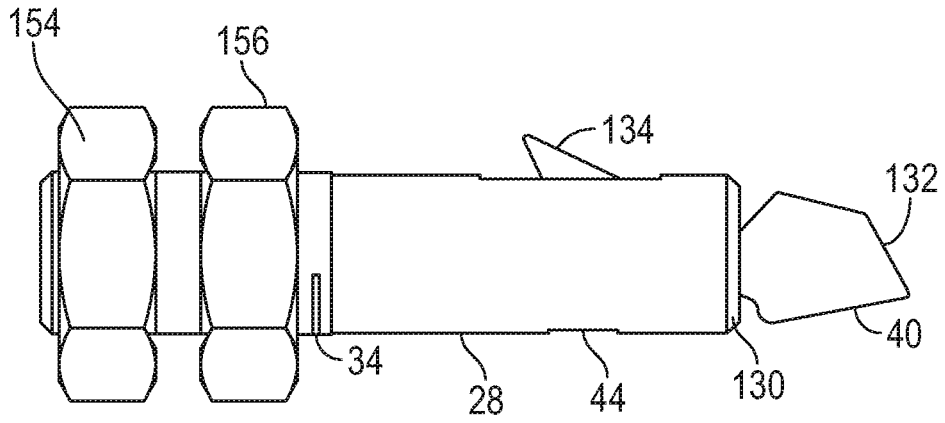
FIG. 6 is a side view of an exemplary latching member.
Figure 6A:
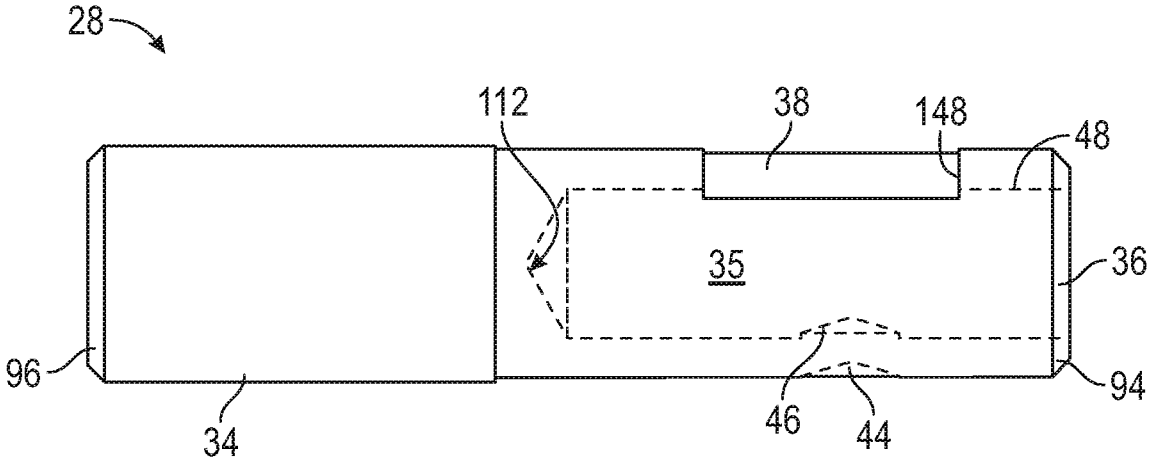
FIG. 6A is a cross-sectional view of an exemplary latching member body.
Figure 6B:
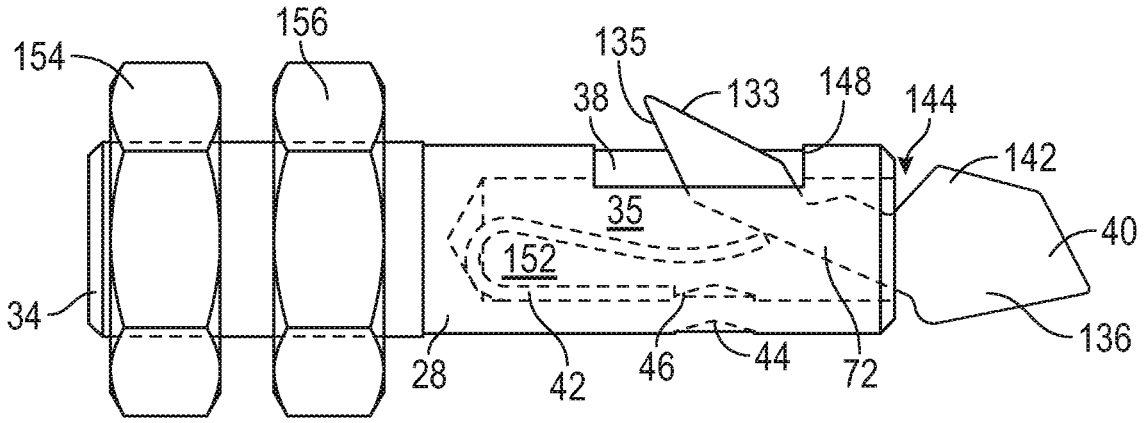
FIG. 6B is a partial cross-sectional view of the latching member in FIG. 6 when not in a compressed position.
Figure 6C:
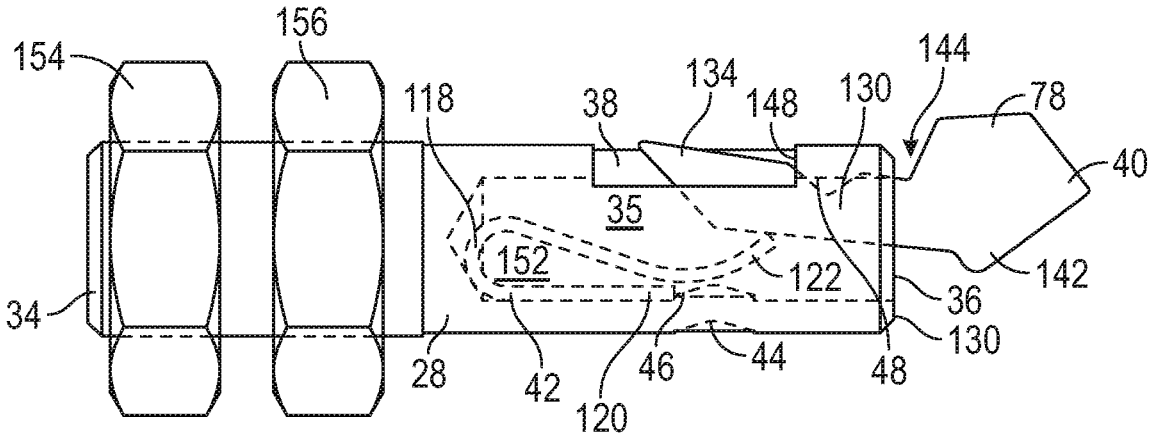
FIG. 6C is a partial cross-sectional view of the latching member in FIG. 6 when compressed.
Figure 7B:
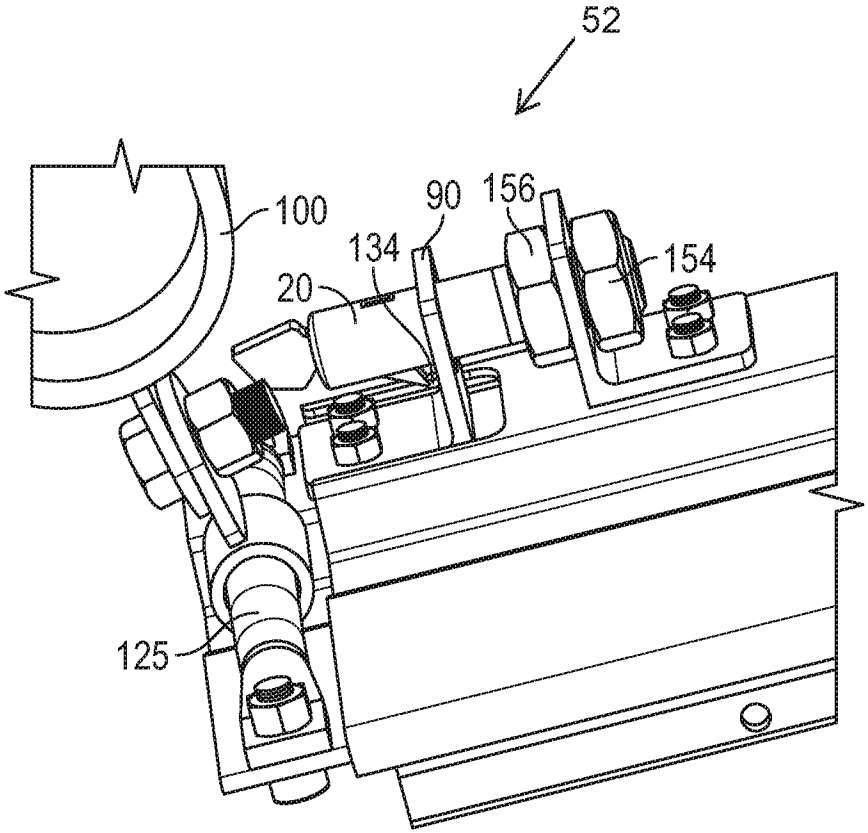
FIG. 7B is a perspective view of the latching member in FIG. 6 when the adjustable toe board is in a substantially restricted position and the locking mechanism is in place.
Figure 7A:
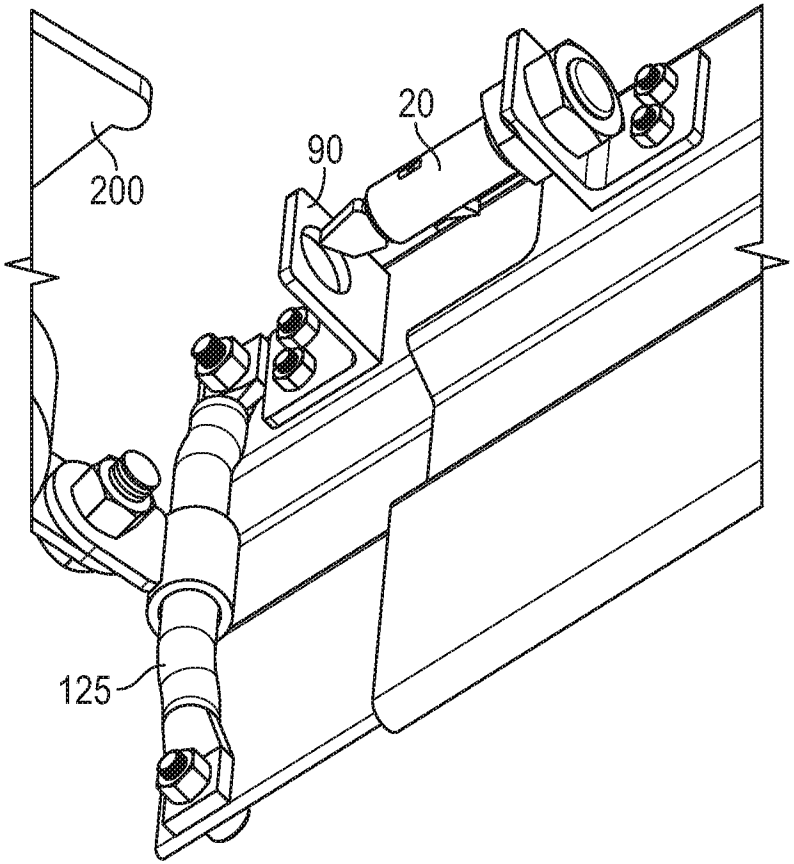
FIG. 7A is a perspective view of the latching member in FIG. 6 when the adjustable toe board is not in a substantially retracted position.

A striking plate 78 having two opposing ends, a retaining member 134 and a striking end 40, is shown. While the depicted exemplary embodiment combines the retaining member 134 and striking end 40 on one single striking plate 78, this is not necessary as the retaining member 134 may be a stand-alone component that is contained within the aperture 38 of the latching member body 28 by its engagement with the resilient member 42 and the cavity engagement surface 48, or otherwise, such that the retaining member 134 will be positioned to perform the function of having a portion of same, the retaining end 104, extend through the aperture 38 yet be movable between a compressed position (as seen in FIG. 6C) and a non-compressed position (as seen in FIG. 6B) through the compression of the resilient member 42 or otherwise. The function of the retaining member 134 is to allow the aperture of the locking plate 90 place the retaining member 134 in a compressed state to allow a portion of the latching member 20 proximate the retaining member 134 to be inserted through the aperture on the locking plate 90. The retaining member 134 will then move to its uncompressed position once the pressure exerted on it by the locking plate 90 is released through the completion of the movement of the locking plate 90 over the retaining member 134. The retaining end 135 of the retaining member 134 will extend out of the aperture 38 in the retaining member's 134 uncompressed position thereby preventing the unintentional dislodgment of the latching member 20 from the locking plate 90 until a user unlocks the adjustable toe board 10 and extends it. To release the locking mechanism and expand the adjustable toe board 10, pressure is applied to the striking plate 40 of the latching member 20 to press same down thereby compressing the resilient member 42 and moving the retaining member 134 from its uncompressed position to its compressed position whereby the retaining end 135 is lowered into the aperture 38. The lowering of the retaining end 135 at least partially into the aperture 38 allows enough clearance for the aperture of the locking plate 90 to slide over the retaining member 134 thereby allowing the adjustable toe board 10 to be unlocked and extended as needed.

The depicted retaining end 135 of the retaining member 134 extends through and outside of the aperture 38 of the latching member body 28. The retaining member engagement end 122 of the resilient member 42 is positioned within the cavity 35 proximate the front edge 148 of the aperture 38. The retaining member 134 is movable between a compressed position (FIG. 6C) and a non-compressed position (FIG. 6B). The retaining member 134 is held in its substantially non-compressed position by the force placed upon it by the retaining member engagement end 122 of the resilient member 42. The retaining member 134 extends along a portion of the aperture 38 proximate the retaining member engagement end 122 of the resilient member 42 wherein the retaining member engagement end 122 makes contact with the underside 72 of the retaining member 134 thereby exerting pressure on the retaining member 134 and positioning its cavity engagement surface 130 close to or against a portion of the striking plate engagement surface 48 of the aperture 38. The retaining end 135 of the retaining member 134 extends through and out of the aperture 38 such that a portion of the retaining member 134 is extending outside of the interior of the latching member body 28. The amount of the retaining member 134 that extends outside of the latching member body 28 is dependent on the corresponding aperture of the locking plate 90 that will be utilized with the latching member 20. The retaining end 135 of the retaining member 134 extends outside of the latching member body 28 enough such that the aperture of the locking plate 90 will fit over the outer diameter of the latching body member 28 and over the retaining member 134 when resilient member 42 is in its compressed state and the retaining member 134 while it is in its compressed position yet the diameter of the aperture of the locking plate 90 will be too small to fit over the retaining member 134 when it is in is un-compressed position such that the retaining member 134 will retain the adjustable toe board 10 in its substantially retracted position until the latching member 20 is purposely unlatched from the locking plate 90.

The engagement between the striking plate engagement surface 48 of the latching member body 28 and the cavity engagement surface 130 of the retaining member 134 when the resilient member 42 is installed and acting on the retaining member 134 will prevent the striking plate 40 from sliding out of the cavity 35. The engagement of the two surfaces 48, 130 also allows for the pivoting of the striking plate 40 when the retaining member 134 is moved to its compressed position and when the pressure on the retaining member 134 is released and it returns to its uncompressed position.

The retaining member engagement end 122 may be slightly curved upward such that the tip 126 of the end 122 may engage at least a part of the underside 72 of the retaining member 134 to bias the retaining member 134 into its uncompressed position.

The cavity engagement surface 130 depicted has four adjacent planes of varying angles that together create two notches 70. Of course, it is understood that the cavity engagement surface 130 may have any number of geometries and/or notches. The purpose of the engagement striking plate engagement surface 48 and the cavity engagement surface 130 is to allow for the interaction between the two surfaces 48 and 130 in order to maintain the striking plate 40 and its retaining member 134 in position within the cavity 35.

In the exemplary embodiment shown, the width of the striking plate 78 is generally uniform; however, the striking plate 78 may have varying widths throughout in alternative embodiments. The striking plate is at least partially retained within a portion of the cavity 35 by its placement in relation to the striking plate engagement surface 48 and the resilient member 42. The cavity engagement surface 130 of the striking plate 40 sits intermediate the retaining member 134 and the striking end 40. The depicted exemplary embodiment of the striking plate 78 is of a single construction having all three sections: the striking end 40, the cavity engagement surface 130, and the retaining member 134. It is understood that the striking end 40, the cavity engagement surface 130, and/or the retaining member 134 may alternatively be independent components retained independently in relation to the quick release latching member 20 or in any number of varying combinations.

Alternatively, the striking end 40, cavity engagement surface 130, and retaining member 134 may be in alternative arrangements, such as having a single component comprised of both the retaining member 134 and the cavity engagement surface 130, wherein the striking end 40 is formed out of the latching member body 28 itself. In this case the referenced striking plate 78 would be formed from the retaining member 134 and the cavity engagement surface 130, wherein the striking end 40 would be formed as part of the latching member body 28.

Alternatively, the striking end 40 may be an independent component, while the referenced striking plate 78 would be formed by the retaining member 134 and the cavity engagement surface 130. A further alternative embodiment may not contain a striking end 40.

The striking end 40 has a tip 136. The tip 136 is the leading edge of the striking end 40 that extends out of the cavity opening 36 of the latching member body 28 and away from the cavity 35. The tip 136 is shaped such that it will easily pass through the aperture of the locking plate 90. The tip 136 may form an acute angle. An exemplary acute angle is seventy-four degrees, though other angels may be utilized. While a tip 136 is not necessary for the present invention, when it is present it will be of a smaller size in relation to the portion of the striking end 40 proximate the cavity opening 36 whether the tip 136 it is shaped at an acute angle 108 or otherwise.

Generally, the preferred embodiment of the tip 132 has a smaller surface area than at least a portion of the rest of the striking end 40. Typically, the tip 132 will have a smaller surface area than the area of the striking end 40 adjacent to the tip 132.

The base 142 of the striking end 40 is located proximate the cavity engagement surface 130. The base 142 is positioned outside of the cavity 35 and at least a portion of the base 142 is larger than the diameter of the cavity 35 such that at least a portion of the base 142 will not fit inside the cavity 35. This sizing of the base 142 prevents full insertion of the striking end 40 into the cavity 35. This sizing will further aid in the construction of the latching members 20 by allowing for proper positioning of the striking plate 78 inside the cavity 35.

An open spacing 144 is maintained between the base 142 section of the striking end 40 proximate the cavity opening 36. This open spacing 144 allows for at least some movement of the striking end 40 in relation to the cavity opening 36. The movement within at least a portion of the open spacing 144 by the striking end 40 may be in response to the application of downward pressure on the retaining member 134 or pressure on the striking plate 40.

The open spacing 144 may not be present in the alternative embodiments that utilize a striking end 40 that is formed from the latching member body 28 or that is otherwise fixedly connected to the latching member body 28, such as by welding or bolting. Further, the open spacing 144 may not be present in alternative embodiments that contain a striking end 40 that is not part of the striking plate 78, or that is otherwise not coupled to the retaining member 134.

The retaining member 134 of the striking plate 78 is positioned distal the tip 136. The retaining member 134 is sized to at least partially extend through the latching member aperture 38 of the latching member body 28. The latching member aperture 38 is sized to allow for downward movement of the retaining member 134 when it is depressed either by a user, the walls of the aperture on the locking plate 90, or by any other means.

The retaining member 134 has a front portion 133 that faces the direction of the cavity opening 36, and a back portion 135 that faces the retaining nut 154. Both the front 133 and back 135 portions extend out beyond the outer surface of the latching member body 28. The front edge 148 of the aperture 38 is located proximate the front portion 133 of the retaining member 134. The positioning of the retaining member 134 against the front edge 148 of the latching member body aperture 38 by the resilient member 42 allows the retaining member back portion 135 to remain extended away from the outer surface of the latching member body 28 such that it will act as a barrier preventing the latching member 20 from releasing from the locking plate 90. The barrier created by the retaining member 134 thereby effectively retains or locks the adjustable toe board 90 in its substantially retracted position.

The retaining member 134 is positioned at an ascending vertical angel in relation to the axis of the latching member body 28 such that it is cantilevered at the front edge 148 of the latching member aperture 38 and extends backward and upward away from the striking end 40 and towards the retaining nut 154. The positioning of the retaining member 134 in combination with the latching member body 28 creates a larger surface area around this area of the latching member body 28 in relation to the outer surface of the adjacent section of the latching member body 28. This larger surface area begins at the location of retaining member 134 proximate the front edge 148 of the latching member aperture 38 and increases along a part of the length of the retaining member 134 along the aperture 38 in the direction of the retaining nut 154.

In alternative embodiments, any type of spring lock or latching mechanism, slam latch, Norfolk latch, Suffolk latch, toggle latch, other latching mechanism, and/or other self-contained retaining mechanism, may be utilized in some or all of the latching members, whether now know or later developed.

The latching member is retained on the outer toe board 60 through attachment to the latching member anchor 88. The latching member anchor 88 contained an aperture extending therethrough. A nut 156 is threaded onto the threaded end 34 of the latching member body 28. The threaded end 34 of the latching member body is inserted into the aperture of the latching member anchor 88 and a retaining nut 154 is fastened onto the threaded end 34 of the latching member body that is extending out of the aperture of the latching member anchor 88. The latching member 20 is then removably attached to the latching member anchor 88.

Alternatively, the latching member may be welded or otherwise permanently attached to the outer toe board 60. Alternatively, any now known or later discovered method for retaining the latching member 20 onto the outer toe board 60 may be utilized.

Figure 8A:
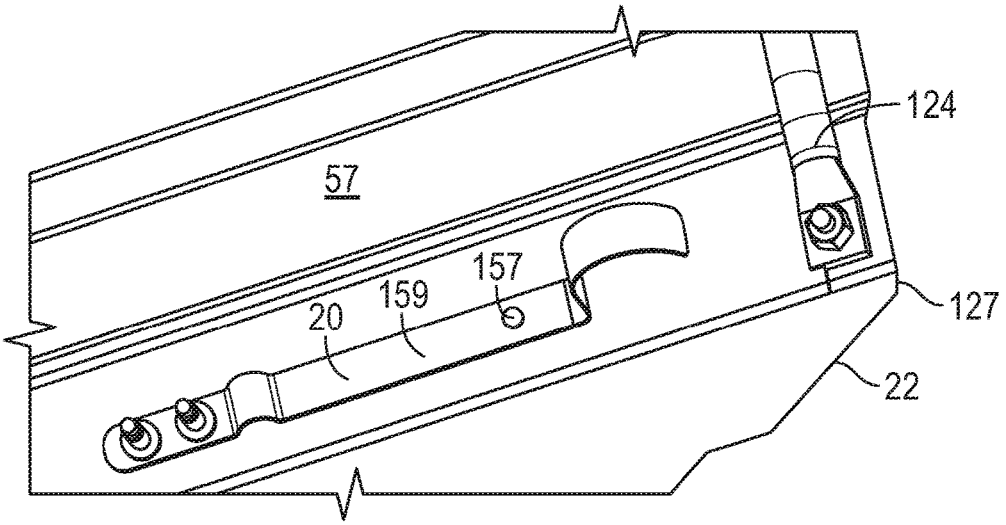
FIG. 8A is a perspective view of an alternative latching member.
Figure 8B:
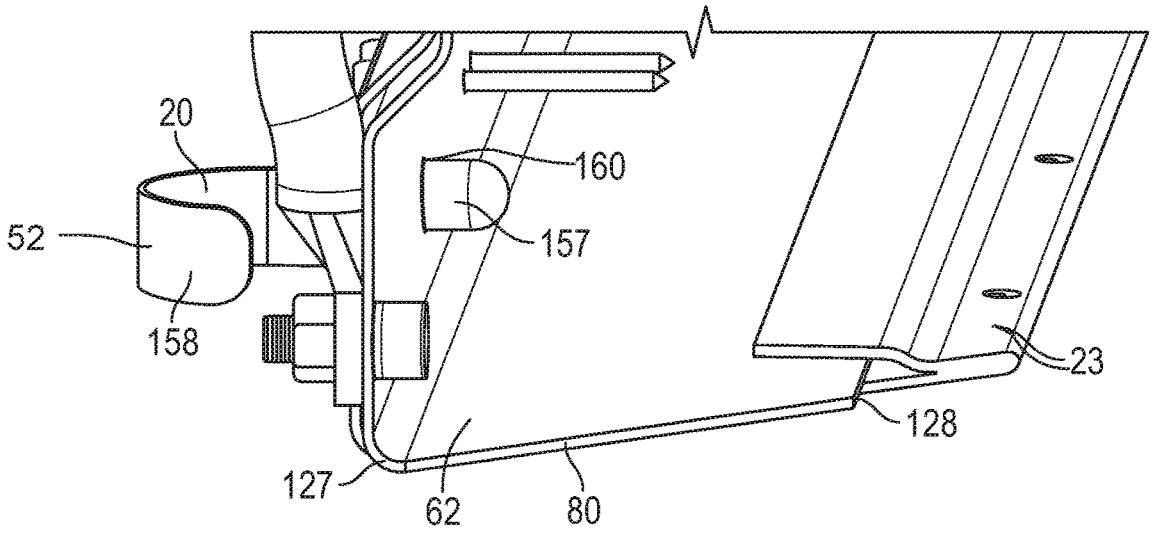
FIG. 8B is a perspective view of the alternative latching member in FIG. 8A when latched.

Referring to FIGS. 8A and 8B, an alternative embodiment of a latching member 20 is shown. A spring lock latching member 20 is shown having an elongated body 159 attached to the outer board upright portion 66 along a portion of the exterior surface 57 of the outer toe board 60. The spring lock latching member 20 has a locking pin 157. The locking pin 157 may be retractable into the spring lock latching member 20. The inner board upright portion 136 has a locking aperture 160 extending therethrough proximate the inner board combined edge 127 and the inner board first side 80. When the adjustable toe board 10 is in its fully retracted position, the locking pin 157 extends through the locking aperture 160 and locks the adjustable toe board 10 in the substantially retracted position. To release, the user pulls on the release hook 158 to remove the locking pin 157 from the locking aperture 160 and expand the toe board 10. Once the adjustable toe board 10 is in position, the fork assemblies 100 are attached to the tubes of the scaffold to hold the toe board in place.

Referring to FIGS. 9, 9A, 9B, 10, 10A and 10B, exemplary connecting members 100 are shown. The exemplary connecting member 100 is a wedge system 200 having a wedge pin capable of near universal use with the majority of scaffolds in use, and a fork 202.

An exemplary fork 202 is generally U-shaped having two legs extending from opposite sides of its midpoint: a first fork leg 206 and a second fork leg 208. The legs 206 and 208 end at respective termination points 204. Each leg contains an aperture extending therethrough: a first fork leg aperture 210 and a second fork leg aperture 212.

The first fork leg aperture 210 is wider in width and shorter in length than the second fork leg aperture 212. This is shown more clearly in FIG. 10B. The wedge pin 200 is inserted into the fork 202 at its smaller end 214 through the second fork leg aperture 212. The wedge pin 200 then has a wedge stop 216, such as a rivet, installed at its smaller end 214 to prevent movement of the wedge pin through the second fork leg aperture 212 thereby retaining the wedge pin 200 in the fork 202. This aids in keeping the wedge pin 200 in close proximity to the fork 202 to make for quick and easy installation when needed on site without the need to search for wedge pins 200 for use. The wedge stop 216 is insertable through the second fork leg aperture 212 due to its increased width in relation to the first fork leg aperture 210. Alternatively, the wedge pin 200 may not have a wedge stop 216 installed thereon.

The wedge pin 200 is a generally flat member that has a smaller end 214 and an opposite larger end 218, and along its length, an interior side 220 and an opposite exterior side 222. The wedge pin 200 has a first side 219 and a second side 215. The wedge pin 200 also has a front surface 226 and a back surface 228. The interior side 220 of the wedge pin 200 is referring to its position in the interior of the fork 202 against the object 102, such as a scaffold vertical member, being a post, pole, or the like, that the connecting member 100 is coupled to. The exterior side 222 of the wedge pin 200 is referring to its position facing outward away from the interior of the fork where the object 102 will be positioned, therefore, being on the exterior of the wedge pin 200 in relation to the interior side 220.

The interior side 220 of the wedge pin 200 has a general slope inward from a position proximate the larger end 218 of the wedge pin 200 along the length to a point proximate the smaller end 214. At approximately the midpoint between the larger end 218 and the smaller end 214 of the wedge pin 200, along the interior side 220, the interior side 220 slopes outward 224 away from the interior of the wedge pin 200. The start point of the outward slope in relation to the first side 219 of the wedge pin 200 may be between 65 and 90 mm. Preferably the start point of the outward slope is between 70 mm and 80 mm, and more preferably the start point is between 72 mm and 78 mm. The outward slope 224 extends for a predetermined length, at which point the remaining length of the interior side 220 begins to again gradually slope in towards the smaller end 214 to a point proximate the smaller end 214. The outward slope 224 creates a bump 224 along the length of the interior side 220.

The exterior side 222 of the wedge pin 200 has seven distinct changes in slope along its length. The differences in slope along the length of the wedge pin 200 on the exterior side 222 allow for varying interactions of the exterior side 222 with the first fork leg aperture 210 and the second fork leg aperture 212 to retain a toe board to a variety of sized and shaped objects 102. Proximate the larger end 218 of the wedge pin 200, the exterior side 222 begins to extend toward the smaller end 214 at a first gradual slope inward 231 toward the interior of the wedge pin 200. At a point between the larger end 218 and the midpoint along the length of the exterior side 222, the slope increases causing a first more pronounced inward slope 232 along a portion of the exterior side 222. The start point of the first more pronounced inward slope 232 in relation to the first side 219 of the wedge pin 200 may be between 25 mm and 50 mm. Preferably the start point of the first more pronounced inward slope 232 is between 30 mm and 45 mm, and more preferably between and 40 mm.

The first more pronounced inward slope 232 may extend the length of between 9 mm and 20 mm. Preferably the length of the first more pronounced inward slope 232 is between 10 mm and 15 mm, and more preferably the length is between 10.5 mm and 12 mm.

Thereafter, the exterior side 222 of the wedge pin 200 returns to a gradual inward slope towards the smaller end 214, a second gradual inward slope 233. The second gradual inward slope 233 may extend the length of between 15 mm and 30 mm. Preferably the length of the second gradual inward slope 233 is between 18 mm and 25 mm, and more preferably the length is between 19 mm and 23 mm.

Thereafter, the exterior side 222 of the wedge pin 200 begins its first pronounced outward slope 234 away from the interior of the wedge pin 200. In relation to the exterior side 222 surface proximate to the start point of the first pronounced outward slope 234 and intermediate the second gradual inward slope 233 and the first pronounced outward slope 234 ("measure point"), the first pronounced outward slope 234 may be between 1 mm to 10 mm away from the measure point at its farthest point outward. Preferably, the first pronounced outward slope's 234 furthest point outward is between 1.5 mm and 5 mm, more preferably the furthest outward point is between 2.5 mm and 3.5 mm.

The first pronounced outward slope 234 may extend the length of between 3 mm and 15 mm. Preferably the length of the first pronounced outward slope 234 is between 4.5 mm and 10 mm, and more preferably the length is between 5.5 mm and 8 mm.

The start point of the first pronounced outward slope 234 in relation to the first side 219 of the wedge pin 200 may be between 50 mm and 90 mm. Preferably the start point of the first pronounced outward slope 234 is between 60 mm and 80 mm, and more preferably between 65 mm and 75 mm.

Thereafter, the exterior side 222 of the wedge pin 200 begins a third gradual inward slope 235 towards the smaller end 214. The start point of the third gradual inward slope 235 in relation to the first side 219 of the wedge pin 200 may be between 50 mm and 90 mm. Preferably the start point of the third gradual inward slope 235 is between 65 mm and 86 mm, and more preferably between 72 mm and 80 mm.

The third gradual inward slope 235 may extend the length of between 15 mm and 50 mm. Preferably the length of the third gradual inward slope 235 is between 22 mm and 40 mm, and more preferably the length is between 25 mm and 35 mm.

Thereafter, the exterior side 222 of the wedge pin 200 begins a second more pronounced inward slope 236 towards the interior of the wedge pin 200 in the direction of the smaller side 215. The start point of the second more pronounced inward slope 236 in relation to the first side 219 of the wedge pin 200 may be between 85 mm and 115 mm. Preferably the start point of the second more pronounced inward slope 236 is between 95 mm and 110 mm, and more preferably between 100 mm and 110 mm.

The second more pronounced inward slope 236 may extend the length of between 3 mm and 30 mm. Preferably the length of the second more pronounced inward slope 236 is between 5 mm and 20 mm, and more preferably the length is between 6 mm and 18 mm.

In relation to the exterior side 222 surface proximate the start point of the second more pronounced inward slope 236, the angle of slope for the second more pronounced inward slope 236 may be between 5 degrees and 25 degrees. Preferably, the angle of the slope of the second more pronounced inward slope 236 is between 10 degrees and 20 degrees, more preferably the angle of the slope is between 12 degrees and 18 degrees.

Thereafter, the exterior side 222 of the wedge pin 200 begins a fourth gradual inward slope 237 towards the smaller end 214 and the second side 215 of the wedge pin 200. The start point of the fourth gradual inward slope 237 in relation to the first side 219 of the wedge pin 200 may be between 90 mm and 130 mm. Preferably the start point of the fourth gradual inward slope 237 is between 100 mm and 125 mm, and more preferably between 113 mm and 123 mm.

The fourth gradual inward slope 237 may extend the length of between 10 mm and 40 mm. Preferably the length of the fourth gradual inward slope 237 is between 15 mm and 35 mm, and more preferably the length is between 23 mm and 33 mm.

The various gradual inward slopes referenced above may be insignificant slopes along the set length of the exterior side 222 of the wedge pin 2000 whereby the effect is no real slope at all.

All ranges disclosed herein are inclusive of the respective outer limits listed.

Figure 9:
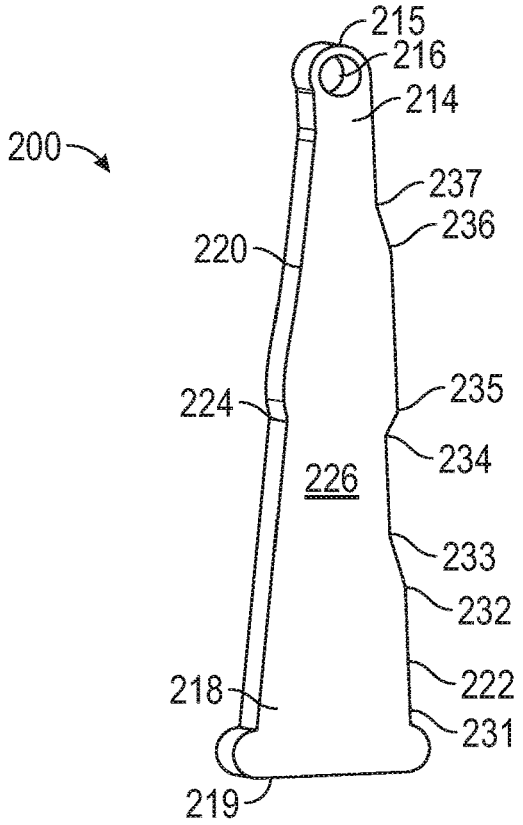
FIG. 9 is a front view of an exemplary wedge pin.
Figure 9A:
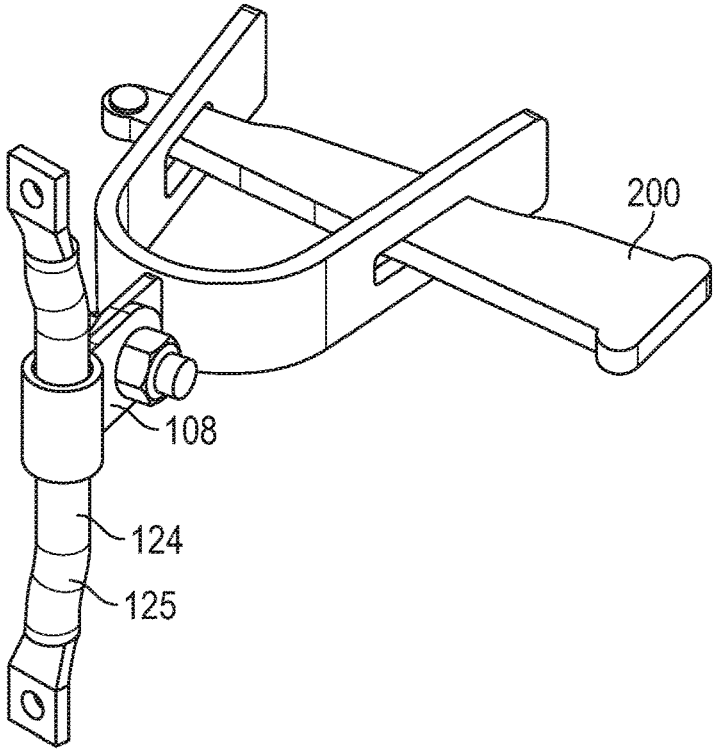
FIG. 9A is a perspective view of the connecting member coupled to connecting member anchor.
Figure 9B:
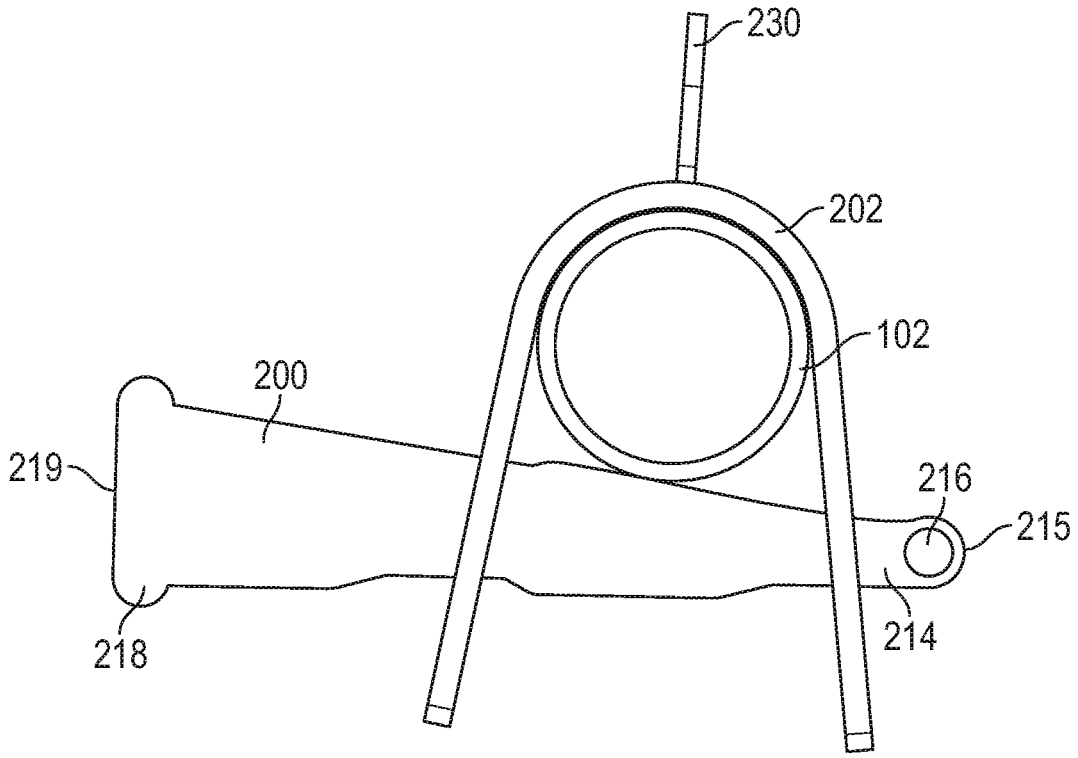
FIG. 9B is a top view of the connecting member in FIG. 9A installed on an object.
Figure 10:
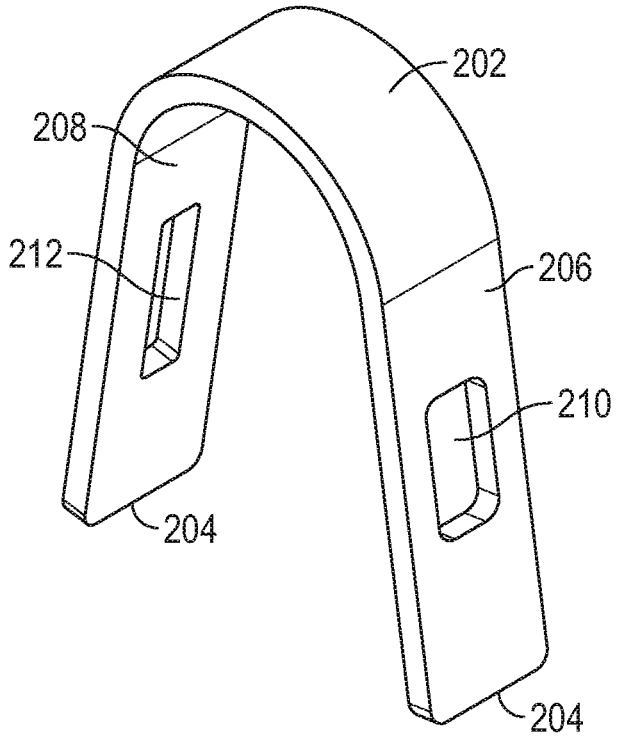
FIG. 10 is a perspective view of the exemplary fork of the connecting member in FIG. 9A.
Figure 10A:
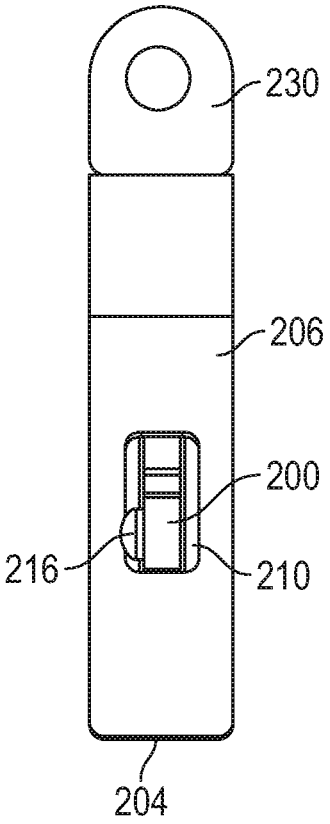
FIG. 10A is a side view of the connecting member.
Figure 10B:
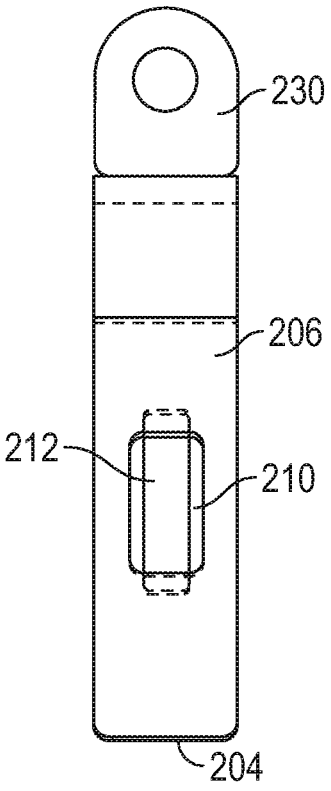
FIG. 10B is a side view of the fork showing the difference between the first fork leg aperture and the second fork leg aperture.

The wedge pin 200 may include a laterally elongated portion at its larger end 218 proximate its first side 219 to aid in handling the wedge pin 200 by the user, as shown in FIG. 9. The smaller end 215 may be rounded to aid in inserting the wedge pin 200 into the fork leg apertures 210 and 212.

The fork 202 may have a fork connector 230 welded or otherwise fixedly attached to the fork 202 for connection to a toe board 10. When installed on an object 102, the wedge pin 200 is removed from the first fork leg aperture 210 to allow for insertion around an object 102. Once inserted on around the object 102 the wedge pin 200 is reinserted into the first fork leg aperture 210 along its smaller end 214 and the wedge pin 200 is pushed until pressure is asserted onto the object 102 and the wedge pin 200 is wedged into position, see FIG. 12. The various sections along the wedge pin 200 allow for better placement in relation thereto to allow for retaining the toe board 10 onto a greater number of objects 102.

Referring to FIGS. 2A, 3A, 3D, 4A, 4D and 9A, exemplary connecting members 100 are shown installed on the adjustable toe board 10. A generally cylindrical connecting member anchor 124 and 125 is provided. The connecting member anchors 124 and 125 are connectable to the toe board 10 at their respective ends. Connecting member anchor 124 is attached to the outer toe board 60 proximate the outer board second side 25. Connecting member anchor 125 is attached to the inner toe board 62 proximate the inner board first side 80.

An attachment member 108 is coupled to each of the connecting member anchors 124 and 125 and is moveable in relation to the connecting member anchor 124 or 125 that is it coupled to. A fork 202 can then be coupled to each respective connecting member anchor 124 or 125 by attachment of the fork connector 230 with the respective attachment member 108. The fork 202 is moveable in relation to the connecting member anchor 124 or 125 along at least a portion of its shaft when installed thereon. The fork 202 may also be moveable in relation to the attachment member 108 that it is coupled to. The movement of the fork 202 in relation to the toe board 10 will aid in connecting the fork 202 to the desired object 102.

Figure 11:
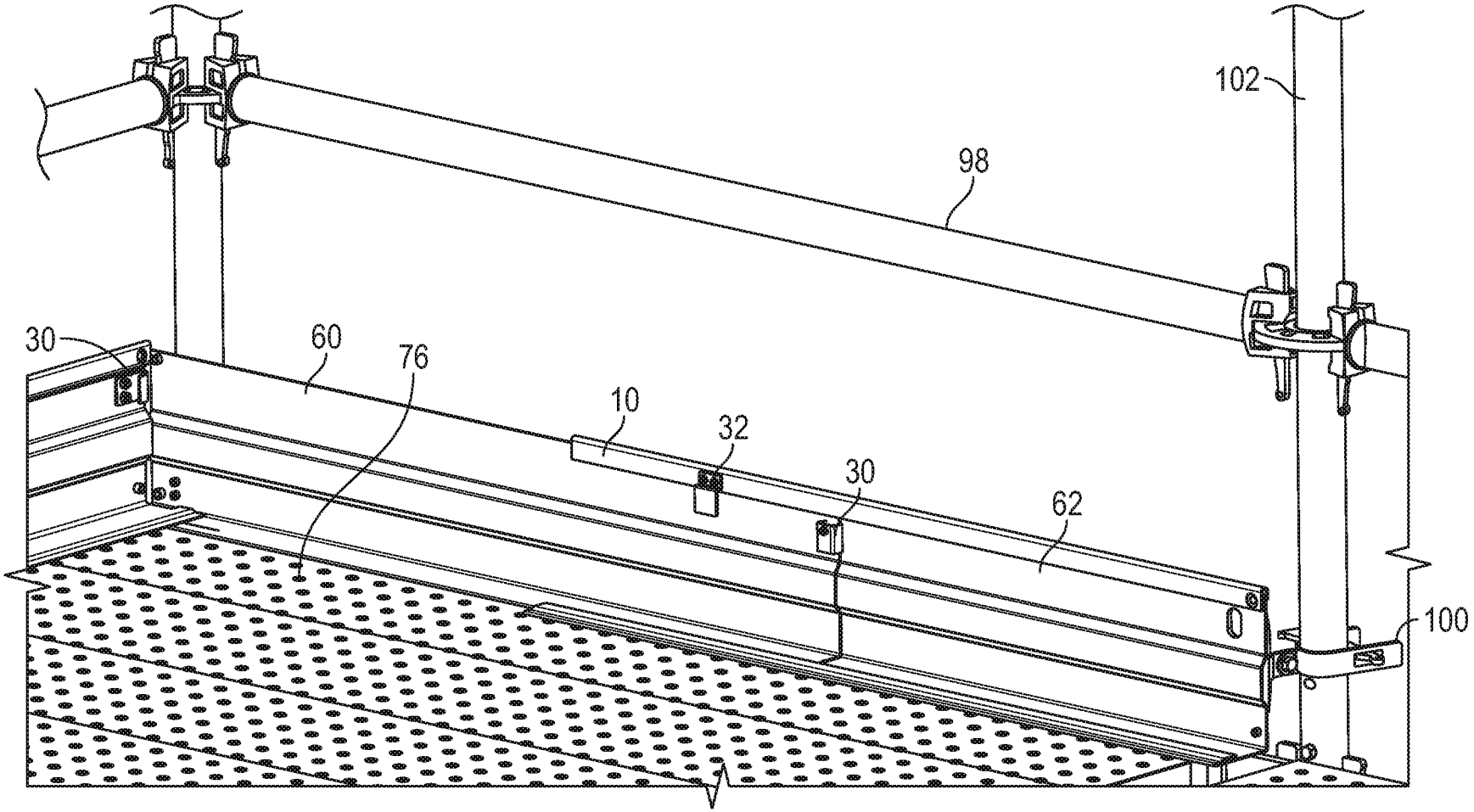
FIG. 11 is a perspective view of an exemplary scaffold platform having an adjustable toe board of the invention installed thereon.
Figure 12:
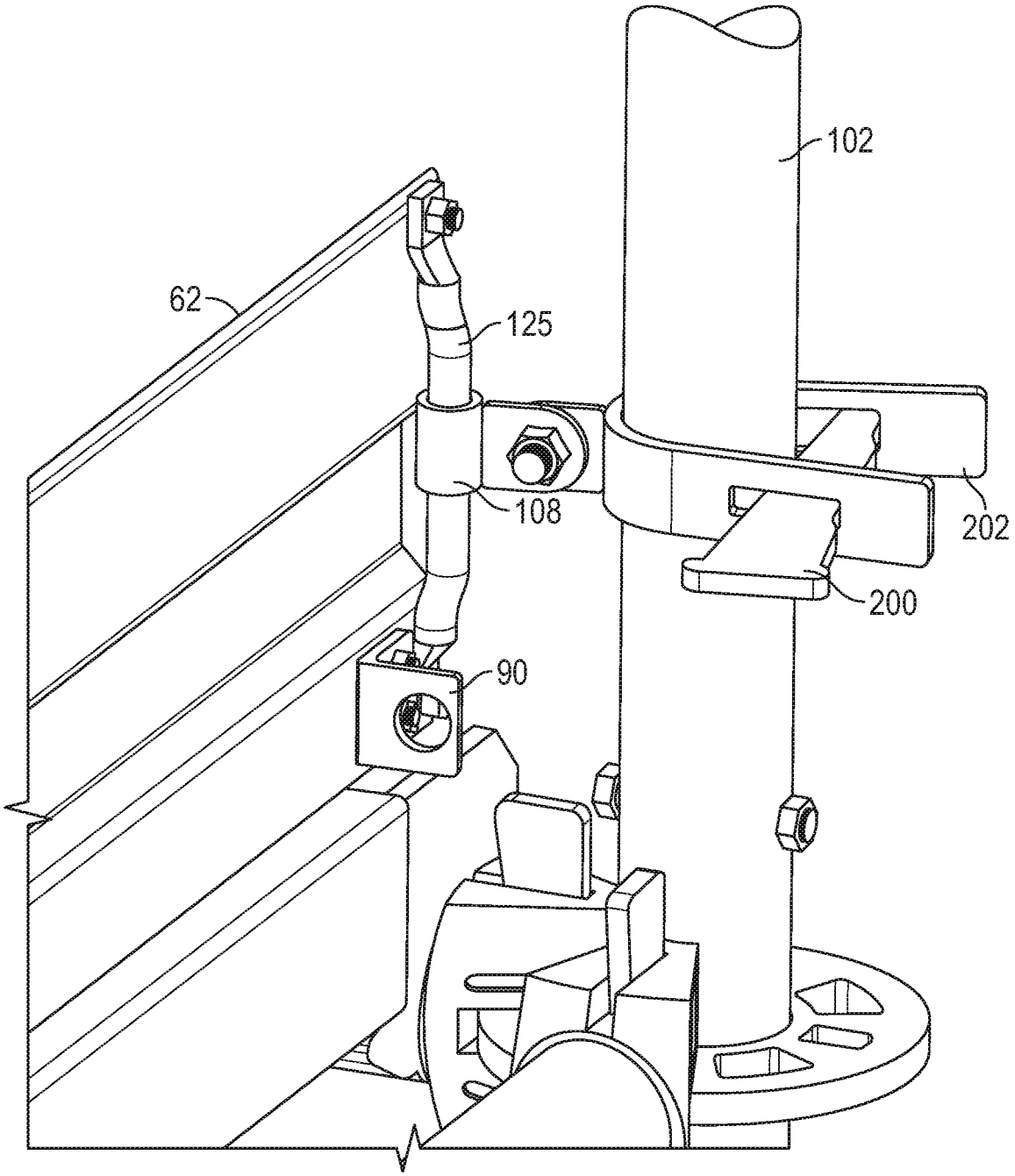
FIG. 12 is a perspective view of an installed wedge system.

Referring to FIGS. 11 and 12, an exemplary platform 76 of a scaffold is shown having guard rails 98 and a vertically extending post 102. The adjustable toe board 10 is shown in its installed position with the connecting members installed on the post 102.

The term spring as used herein refers to any resilient member of any shape that is operable in the invention, and may be made from any suitable material. For example, the spring may be comprised of a compressible fluid.

The depicted exemplary embodiments may be altered in a number of ways while retaining the inventive aspect, including ways not specifically disclosed herein.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features and characteristics described in conjunction with a particular aspect, embodiment or example of the invention are to be understood to be applicable to any other aspect, embodiment or example described herein unless incompatible therewith.

All of the features disclosed in this specification (including any accompanying claims, abstract and drawings), and/or all of the steps of any method or process so disclosed, may be combined in any combination, except combinations where at least some of such features and/or steps are mutually exclusive. In other words, the method steps have not been provided for in any particular sequential order and may be rearranged as needed or desired, with some steps repeated sequentially or at other times, during use.

Each feature disclosed in this specification (including any accompanying claims, abstract and drawings), may be replaced by alternative features serving the same, equivalent, or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

We claim:

1. An adjustable toe board, comprising:

an adjustable toe board comprising an outer board and an inner board, wherein the inner board is movable in relation to the outer board between a substantially retracted position to a substantially extended position, and is movable to various positions therebetween;

a locking mechanism comprising a latching member coupled to the outer board and a corresponding locking member coupled to the inner board;

wherein the latching member having a protrusion, and the locking member having an aperture extending through at least a portion thereof, such that when the outer board and inner board are coupled in the substantially retracted position, the latching member protrusion extends at least partially within the locking member aperture;

the latching member having a latching member body;

the latching member body having an anchoring end and a retaining end distal the anchoring end;

the latching member body having external threading along at least a portion of its anchoring end;

a latching member anchor coupled to the outer toe board, the latching member anchor having an aperture extending therethrough; and the at least a portion of the anchoring end of the latching member body is placed within the aperture of the latching member anchor and a threaded fastener is coupled to the external threading of the anchoring end to retain a portion of the latching member body in the latching member anchor aperture.

2. The adjustable toe board of claim 1, further comprising: a limit hook connected to the inner board and a corresponding limit plate connected to the outer board, wherein the limit hook and limit plate couple when the inner board and outer board are in their substantially extended position in relation to each other.

3. The adjustable toe board of claim 1, further comprising:

the outer toe board having an outer board first side and an outer board second side;

the outer toe board having an outer board upper edge extending between the outer board first side and the outer board second side along the length of the upper perimeter of the outer toe board;

the outer toe board having an outer board outer edge extending between the outer board first side and the outer board second side along the length of the lower perimeter of the outer toe board;

the outer board upper edge having a retaining channel extending along at least a portion of the upper edge of the outer toe board;

the outer board outer edge having a retaining channel extending along at least a portion of the outer edge of the outer toe board;

the inner toe board having an inner board first side and an inner board second side;

the inner toe board having an inner board upper edge extending between the inner board first side and the inner board second side along the length of the upper perimeter of the inner toe board;

the inner toe board having an inner board outer edge extending between the inner board first side and the inner board second side along the length of the lower perimeter of the inner toe board; and wherein at least a portion of the upper edge of the inner toe board extends within at least a portion of the upper edge retaining channel of the outer toe board, and wherein at least a portion of the outer edge of the inner toe board extends within at least a portion of the outer edge retaining channel of the outer toe board.

4. The adjustable toe board of claim 3, further comprising:

wherein the outer toe board is an elongated generally L-shaped member having an outer board upright portion and an outer board base portion extending from the outer board upright portion;

wherein the outer edge of the outer toe board runs the length of the outer perimeter of the outer board base portion that is extending away from the outer board upright portion;

wherein the inner toe board is an elongated generally L-shaped member having an inner board upright portion and an inner board base portion extending from the inner board upright portion; and wherein the outer edge of the inner toe board runs the length of the outer perimeter of the inner board base portion that is extending away from the inner board upright portion.

5. The adjustable toe board of claim 4, further comprising:

an opening is formed along a section of the upright portion of the outer toe board, wherein the opening extends from the first side of the outer toe board to a position proximate the latching member;

the latching member protrusion being a retaining member;

the retaining member being movable between a compressed position and a non-compressed position, wherein in the non-compressed position the retaining end of the retaining member extends further outward from the latching member than when the retaining member is in its compressed position; and wherein the retaining member of the latching member travels through the locking member aperture when the adjustable toe board is in a substantially retracted position.

6. The adjustable toe board of claim 1, further comprising:

a striking plate having a retainment member portion and a striking portion;

the latching member body having an opening extending through at least a portion of its retaining end;

wherein the striking portion at least partially extends out of the opening;

the locking member being a locking plate wherein the aperture extends through at least a portion thereof; and wherein the striking portion and retaining member portion of the latching member body travel through the locking plate aperture when the adjustable toe board is in a substantially retracted position, and wherein the retaining member portion acts to retain the latching member in engagement with the locking plate to prevent substantial lateral movement between the inner toe board and the outer toe board.

7. The adjustable toe board of claim 1, further comprising:

a fork having a first fork leg and a second fork leg;

the first fork leg having a first fork leg aperture extending therethrough, and the second fork leg having a second fork leg aperture extending therethrough; and wherein the fork is attached to the adjustable toe board, and the fork is coupled with a wedge pin.

8. The adjustable toe board of claim 7, wherein the wedge pin having a first side and a second side, and having a longitudinally extending interior side extending from the first side to the second side, and having a longitudinally extending exterior side extending from the first side to the second side, wherein at least a portion of the distance between the interior side and the exterior side is smaller closer to the first side of the wedge pin in relation to at least a portion of the distance between the interior side and the exterior side closer to the second side of the wedge pin.

9. The adjustable toe board of claim 7, further comprising:

the inner toe board having an inner board first side and an inner board second side;

the outer toe board having an outer board first side and an outer board second side; and wherein the fork is coupled to the adjustable toe board proximate at least one of the inner board first side, outer board first side, inner board second side, or outer board second side.

10. An adjustable toe board, comprising:

an adjustable toe board comprising an inner toe board and an outer toe board;

the inner toe board movable in relation to the outer toe board between a substantially retracted position to a substantially extended position, including various positions therebetween;

the inner toe board having an inner board first side and an inner board second side;

the outer toe board having an outer board first side and an outer board second side;

a connecting member anchor;

a connecting member coupled to the connecting member anchor wherein the connecting member is moveable along at least a portion of the connecting member anchor;

the connecting member anchor comprising a shaft;

the connecting member being coupled to the connecting member anchor along at least a portion of the shaft such that the connecting member is moveable along at least a portion of the shaft of the connecting member anchor while the connecting member anchor is attached to the adjustable toe board;

the shaft of the connecting member anchor extending between two attachment points on the connecting member anchor; and the connecting member anchor being attached to the adjustable toe board at the attachment points such that at least a portion of the shaft is not resting on the surface of the adjustable toe board.

11. The adjustable toe board of claim 10, further comprising:

a latching member coupled to the outer toe board proximate the outer board first side, the latching member having a retaining member thereon wherein the retaining member is movable between a compressed position and a non-compressed position;

a locking member coupled to the inner toe board proximate the inner board first side, wherein the locking member having an aperture extending through at least a portion thereof;

the outer board first side and the inner board first side are on the same side of the adjustable toe board;

the latching member having a body;

the latching member body having a cavity extending at least partially therein;

the cavity ending at an inner wall within the latching member body;

the latching member body having an aperture extending along a portion of the body proximate the cavity such that the aperture creates a passageway from the exterior of the latching member body to the interior of the cavity;

wherein a portion of the retaining member is retained inside the cavity and a portion of the retaining member extends outside of the cavity through the aperture;

a resilient member contained within the cavity of the latching member body;

the resilient member being compressible to allow for compression thereof when pressure is applied to the retainment end of the retaining member, and capable of returning to its original form, or close thereto, when it is no longer in a compressed state;

the retaining member having an underside; and wherein a portion of the resilient member is in contact with the underside of the retaining member.

12. The adjustable toe board of claim 10, further comprising:

the connecting member comprising a fork having a first fork leg and a second fork leg;

the first fork leg having a first fork leg aperture extending therethrough, and the second fork leg having a second fork leg aperture extending therethrough;

the connecting member further comprising a wedge pin; and the fork is coupled with the wedge pin.

13. The adjustable toe board of claim 12, wherein the wedge pin having a first side and a second side, and having a longitudinally extending interior side extending from the first side to the second side, and having a longitudinally extending exterior side extending from the first side to the second side;

the exterior side of the wedge pin having a gradual inward slope angled slightly inward toward the interior of the wedge pin and sloping from the first side of the wedge pin towards the second side of the wedge pin; and the interior side of the wedge pin having an interior side outward slope intermediate the first side and second side of the wedge pin, wherein the interior side outward slope angles outward away from the interior of the wedge pin for a predetermined length sloping away from the first side of the wedge pin towards the second side of the wedge pin, wherein the interior side outward slope subsequently gradually slopes inward forming an interior side gradual inward slope for a predetermined length, wherein the interior side gradual inward slope is positioned intermediate the interior side outward slope and the second side of the wedge pin.

14. The adjustable toe board of claim 10, further comprising:

a latching member comprising a spring lock having a locking pin extending therefrom and a release proximate the locking pin;

an aperture extending through the inner toe board proximate the inner board first side; and wherein the locking pin extends through the inner toe board aperture when the adjustable toe board is in a substantially retracted position, wherein in this position the locking pin prevents lateral movement between the inner toe board and the outer toe board.

15. An adjustable toe board comprising:

an adjustable toe board;

two connecting members coupled to the adjustable toe board;

a pair of wedge pins, each wedge pin coupled to a respective one of the connecting members, each wedge pin generally having four sides: a first side and an opposing second side, and a longitudinally extending interior side that extends between the first side of the wedge pin and the second side of the wedge pin and an opposing longitudinally extending exterior side that extends between the first side of the wedge pin and the second side of the wedge pin;

the longitudinally extending interior side having an interior side protrusion extending along at least a portion of the surface of the longitudinally extending interior side, the interior side protrusion having a bump intermediate the first side of the wedge pin and the second side of the wedge pin with the interior side protrusion gradually tapering inward from the bump towards the second side of the wedge pin;

the longitudinally extending exterior side having a corresponding exterior side protrusion that extends along at least a portion of the longitudinally extending exterior side, wherein the exterior side protrusion is a larger protrusion in relation to the interior side protrusion;

the adjustable toe board having an inner toe board and an outer toe board, wherein the inner toe board is movable in relation to the outer toe board between a substantially retracted position and a substantially extended position, including various positions therebetween;

the inner toe board having an inner toe board first side and an inner toe board second side;

the outer toe board having an outer toe board first side and an outer toe board second side;

a first of the connecting members being coupled proximate the inner toe board first side, and a second of the connecting members being coupled proximate the outer to second side, wherein the outer toe board second side is distal the inner toe board first side;

two connecting member anchors, each comprising a shaft extending between two attachment positions;

each connecting member on the adjustable toe board being coupled to one of the connecting member anchors along at least a portion of the shaft such that the connecting member is moveable in relation to the shaft; and each connecting member anchor is attached to the adjustable toe board at its attachment positions such that at least a portion of the shaft is not directly touching the adjustable toe board.

16. The adjustable toe board of claim 15, further comprising:

each connecting member comprising a fork, each fork having a first fork leg and a second fork leg;

the first fork leg having a first fork leg aperture extending therethrough and the second fork leg having a second fork leg aperture extending therethrough, wherein the second fork leg aperture is thinner and wider in relation to the first fork leg aperture;

intermediate the exterior side protrusion and the first side of the wedge pin, the exterior side of the wedge pin having a first gradual inward slope angled slightly inward toward the interior of the wedge pin and sloping from the first side of the wedge pin towards the second side of the wedge pin; and at the start of the exterior side protrusion proximate the first side of the wedge pin, the exterior side of the wedge pin having a first pronounced outward slope intermediate the first side and second side of the wedge pin, wherein the first pronounced outward slope angles outward away from the interior of the wedge pin for a predetermined length sloping away from the first side of the wedge pin towards the second side of the wedge pin, wherein the first pronounced outward slope subsequently gradually slopes inward forming a third gradual inward slope for a predetermined length.

17. The adjustable toe board of claim 16, further comprising:

a first of the forks coupled to a first of the wedge pins is moveably attached to the outer toe board proximate the outer board second side;

a second of the forks coupled to a second of the wedge pins is moveably attached to the inner toe board proximate the inner board first side;

the exterior side of each wedge pin having a first more pronounced inward slope in relation to the first gradual inward slope for a predetermined length, wherein the inward slope is at a greater angle than the first gradual inward slope, and wherein the first more pronounced inward slope is sloping inward away from the first side of the wedge pin towards the second side of the wedge pin;

wherein the first more pronounced inward slope is positioned intermediate the first gradual inward slope and the first pronounced outward slope;

wherein the first more pronounced inward slope subsequently gradually slopes inward forming a second gradual inward slope for a predetermined length, wherein the second gradual inward slope is positioned intermediate the first more pronounced inward slope and the first pronounced outward slope;

the exterior side of each wedge pin having a second more pronounced inward slope in relation to the third gradual inward slope for a predetermined length, wherein the inward slope is at a greater angle than the third gradual inward slope, and wherein the second more pronounced inward slope is sloping inward away from the first side of the wedge pin towards the second side of the wedge pin;

wherein the second more pronounced inward slope is positioned intermediate the third gradual inward slope and the second side of the wedge pin; and wherein the second more pronounced inward slope subsequently gradually slopes inward forming a fourth gradual inward slope for a predetermined length, wherein the fourth gradual inward slope is positioned intermediate the second more pronounced inward slope and the second side of the wedge pin.

18. The adjustable toe board of claim 17, further comprising:

the bump of the interior side protrusion of the wedge pin having an interior side outward slope intermediate the first side and second side of the wedge pin, wherein the interior side outward slope angles outward away from the interior of the wedge pin for a predetermined length sloping away from the first side of the wedge pin towards the second side of the wedge pin, wherein the interior side outward slope subsequently gradually slopes inward forming an interior side gradual inward slope for a predetermined length, wherein the interior side gradual inward slope is positioned intermediate the interior side outward slope and the second side of the wedge pin.

* * * * *